US012667136B2

(12) United States Patent
Cheng et al.

(10) Patent No.: US 12,667,136 B2
(45) Date of Patent: Jun. 30, 2026

(54) ATOMIZER FOR ELECTRONIC CIGARETTE, AND CARTRIDGE AND ELECTRONIC CIGARETTE HAVING THE SAME

(71) Applicant: BYD PRECISION MANUFACTURE CO., LTD., Shenzhen (CN)

(72) Inventors: Yilin Cheng, Shenzhen (CN); Guiping Hou, Shenzhen (CN); Qibin Jin, Shenzhen (CN)

(73) Assignee: BYD PRECISION MANUFACTURE CO., LTD., Shenzhen (CN)

( * ) Notice: Subject to any disclaimer, the term of this patent is extended or adjusted under 35 U.S.C. 154(b) by 452 days.

(21) Appl. No.: 18/338,275

(22) Filed: Jun. 20, 2023

(65) Prior Publication Data

US 2023/0404161 A1 Dec. 21, 2023

(30) Foreign Application Priority Data

Jun. 20, 2022 (CN) ..... 202210700390.8

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/46*** | (2020.01) |

(52) U.S. Cl.

CPC ..... *A24F 40/485* (2020.01); *A24F 40/10* (2020.01); *A24F 40/42* (2020.01); *A24F 40/46* (2020.01)

(58) Field of Classification Search

None

See application file for complete search history.

(56) References Cited

FOREIGN PATENT DOCUMENTS

| | | | |
|---|---|---|---|
| CN | 205667357 | U | 11/2016 |
| CN | 211241754 | U | 8/2020 |
| CN | 215224745 | U | 12/2021 |
| CN | 215381471 | U | 1/2022 |
| CN | 215603184 | U | 1/2022 |
| CN | 216493478 | U | 5/2022 |
| CN | 217771463 | U | 11/2022 |
| CN | 217771464 | U | 11/2022 |
| WO | 2022088906 | A1 | 5/2022 |

OTHER PUBLICATIONS

Extended European Search Report from corresponding European Application No. EP23180235.6, dated Nov. 22, 2023.

*Primary Examiner* — Katherine A Will

(57) ABSTRACT

The present disclosure discloses an atomizer for an electronic cigarette, and a cartridge and an electronic cigarette having the same. The atomizer includes: a housing, an E-liquid storage chamber, an aerosol passage and an atomizing chamber are arranged in the housing; and at least one gas inlet and an inspiratory mouth are arranged on the housing; and a dimension of the housing in a thickness direction is D, a dimension of the housing in a length direction is L, and a dimension of the housing in a width direction is W, D, L and W meet: $L>W\geq D$, $5\leq L/D\leq 9$, and $2\leq W/D\leq 5$; and an atomizing core fixing member arranged in the housing and provided with an atomizing core communicating with the E-liquid storage chamber and the atomizing chamber, at least one atomization guide channel is defined between the atomizing core fixing member and an inner wall of the housing.

20 Claims, 9 Drawing Sheets

ATOMIZER FOR ELECTRONIC CIGARETTE, AND CARTRIDGE AND ELECTRONIC CIGARETTE HAVING THE SAME

CROSS-REFERENCE TO RELATED APPLICATION

This application claims priority to Chinese Patent Application No. 202210700390.8, filed with the China National Intellectual Property Administration on Jun. 20, 2022, and entitled "ATOMIZER FOR ELECTRONIC CIGARETTE, AND CARTRIDGE AND ELECTRONIC CIGARETTE HAVING THE SAME", the entire contents of which are incorporated herein by reference.

FIELD

The present disclosure relates to the technical field of electronic cigarettes, and more specifically to an atomizer for an electronic cigarette, and a cartridge and an electronic cigarette having the same.

BACKGROUND

An electronic cigarette is an electronic product that imitates cigarettes and has similar appearance, smoke, taste and feeling to cigarettes. In recent years, it is favored by consumers and becomes more and more popular. The electronic cigarette usually provides users with smokable smoke by atomizing an E-liquid.

The electronic cigarette generally includes a cartridge and a cigarette rod, where the cartridge is mounted to the cigarette rod and can produce smoke taken by human. The cartridge is provided with an E-liquid storage chamber, an aerosol passage, an atomizing chamber, and an atomizing core. E-liquid for producing smoke is provided in the E-liquid storage chamber, which enters the atomizing chamber via the atomizing core and is atomized into smoke. The smoke is then taken by a user through the aerosol passage.

In related art, a thickness of the electronic cigarette is large, and a size design of the cartridge is unreasonable, so it is impossible to flatten the cartridge while ensuring small draw resistance, resulting in poor user experience.

SUMMARY

The present disclosure aims to resolve at least one of the technical problems existing in the related art. To this end, one embodiment of the present disclosure is to provide an atomizer for an electronic cigarette, which can increase the air volume in the atomizing chamber, so that an atomizing medium in the atomizing chamber can be fully mixed with air, to ensure a pressure balance between the E-liquid storage chamber and the atomizing chamber.

Another embodiment of the present disclosure is to provide a cartridge using the atomizer.

A further embodiment of the present disclosure is to provide an electronic cigarette using the atomizer and cartridge.

According to an embodiment in a first aspect of the present disclosure, an atomizer for an electronic cigarette includes: a housing, wherein an E-liquid storage chamber, an aerosol passage, and an atomizing chamber communicating with the aerosol passage are located in the housing; and at least one gas inlet communicating with the atomizing chamber and an inspiratory mouth communicating with the aerosol passage are located on the housing, wherein the gas inlet is located on a side surface of the housing; and the housing has a length direction, a width direction, and a thickness direction, wherein a dimension of the housing in the thickness direction is D, a dimension of the housing in the length direction is L, and a dimension of the housing in the width direction is W, in which D, L and W meet: $L>W\geq D$, $5\leq L/D\leq 9$, and $2\leq W/D\leq 5$; and an atomizing core fixing member located in the housing, wherein the atomizing core fixing member separates the E-liquid storage chamber from the atomizing chamber, and the atomizing core fixing member is provided with an atomizing core; wherein the atomizing core communicates with the E-liquid storage chamber and the atomizing chamber respectively, and the atomizing core is configured to atomize a medium to be atomized in the E-liquid storage chamber; and at least one atomization guide channel is defined between the atomizing core fixing member and an inner wall of the housing, the at least one atomization guide channel is separated from the E-liquid storage chamber, and the atomization guide channel communicates the aerosol passage and the atomizing chamber.

In the present disclosure, by a size design of the cartridge as described above, the electronic cigarette can be designed to be ultra-thin maximally while the assembly efficiency of the atomizing core can be improved as much as possible, the atomization efficiency is improved, and a small draw resistance is ensured. That is, the atomizer can be designed to be ultra-thin, so as to provide a good experience when the electronic cigarette is grasped, carried and smoked by users.

According to the atomizer in accordance with the embodiment of the present disclosure, the gas inlet is arranged on a side surface of the housing, the ventilation channel is arranged between the atomizing core fixing member and the atomizing core, the ventilation channel communicates with the E-liquid storage chamber and the atomizing chamber respectively, and D, L and W meet: $L>W\geq D$, $5\leq L/D\leq 9$, and $2\leq W/D\leq 5$. Therefore, compared with a conventional atomizer, the atomizer is designed to be ultrathin, to meet the user requirement during use, and avoid the leakage of the atomizer. Moreover, a pressure difference between the E-liquid storage chamber and the atomizing chamber is adjusted by the ventilation channel, to ensure pressure balance between the E-liquid storage chamber and the atomizing chamber.

According to some embodiments of the present disclosure, the dimension D further meets: $5.0\ \text{mm}\leq D\leq 9.0\ \text{mm}$.

According to some embodiments of the present disclosure, the dimension D further meets: $6.0\ \text{mm}\leq D\leq 8.0\ \text{mm}$.

According to some embodiments of the present disclosure, a dimension of the atomizing core along the width direction of the housing is a length $L_1$ of the atomizing core, and a dimension of the atomizing core along the thickness direction of the housing is a width $w_1$ of the atomizing core, in which $L_1$ and $w_1$ meet: $2\leq L_1/w_1\leq 5$.

According to some embodiments of the present disclosure, the dimension of the atomizing core along the thickness direction of the housing is the width $w_1$ of the atomizing core, in which $w_1$ meets: $2\ \text{mm}\leq w1\leq 3.5\ \text{mm}$.

According to some embodiments of the present disclosure, a groove is formed on a side surface of the atomizing core facing the E-liquid storage chamber. A thickness of the atomizing core at a position corresponding to a bottom wall of the groove is $t_1$, in which $t_1$ meets: $0.6\ \text{mm}\leq t_1\leq 2.5\ \text{mm}$.

According to some embodiments of the present disclosure, a thickness of the atomizing core at a position corresponding to a side wall of the groove is $t_2$, in which $t_2$ meets: $0.6\ \text{mm}\leq t_2\leq 1.5\ \text{mm}$.

According to some embodiments of the present disclosure, the thickness of the atomizing core at the position corresponding to the side wall of the groove is $t_2$, in which $w_1$ and $t_2$ meet: $2.5 \leq w_1/t_2 \leq 6$.

According to some embodiments of the present disclosure, a dimension of the groove along the thickness direction of the housing is a width $w_2$ of the groove, in which $w_1$ and $w_2$ meet: $1.5 \leq w_1/w_2 \leq 6$.

According to some embodiments of the present disclosure, the housing includes: a shell, having one open end, where the inspiratory mouth is formed on another end of the housing; and a seat assembly, located at the open end of the shell, where the E-liquid storage chamber, the aerosol passage and the atomizing chamber are defined between the seat assembly and the shell. The seat assembly includes a seat and a seat shell located at a side of the seat away from the center of the housing. The gas inlet is formed on a side surface of the seat shell, and a gas intake passage bringing the gas inlet and the atomizing chamber into communication is formed on the seat.

According to some embodiments of the present disclosure, a ventilation channel is provided between the atomizing core fixing member and the atomizing core. The ventilation channel communicates with the atomizing chamber and the E-liquid storage chamber respectively.

According to some embodiments of the present disclosure, a side surface of the seat away from the E-liquid storage chamber is at least partially spaced apart from an inner wall of the seat shell to define at least one communicating channel. The gas inlet is brought into communication with the gas intake passage by the communicating channel.

According to some embodiments of the present disclosure, the side surface of the seat away from the E-liquid storage chamber is provided with at least one support member. The support member abuts against the inner wall of the seat shell. At least a portion of an outer peripheral surface of the support member is spaced apart from an inner peripheral surface of the seat shell to define the communicating channel.

According to some embodiments of the present disclosure, a plurality of gas inlets are provided, which are respectively located at two sides of the housing in the width direction of the housing. A plurality of support members are provided, which are respectively located at two sides of the seat in the width direction of the housing.

According to some embodiments of the present disclosure, the atomizer for an electronic cigarette further includes: a gas resistance adjusting member, located at the gas intake passage.

According to some embodiments of the present disclosure, a communicating hole is formed on the gas resistance adjusting member. The communicating hole brings the gas inlet and the atomizing chamber into communication, and has an inner diameter d, in which d meets: 0.8 mm≤d≤1.5 mm.

According to some embodiments of the present disclosure, an electrically conductive member extends through the seat. An accommodating groove is formed on the atomizing core fixing member, and the atomizing core is located in the accommodating groove. An E-liquid storage chamber communicating port is formed at a side of the accommodating groove adjacent to the E-liquid storage chamber. The E-liquid storage chamber is brought into communication with the atomizing core through the E-liquid storage chamber communicating port. The accommodating groove has an open side opening toward the atomizing chamber, and the atomizing core communicates with the atomizing chamber via the open side. One end of the electrically conductive member extends through the open side into the accommodating groove and is electrically connected to the atomizing core. The atomizing core is abutted against and arranged between an inner side wall of the accommodating groove facing the E-liquid storage chamber and the electrically conductive member, so that the atomizing core is fixed.

According to some embodiments of the present disclosure, an atomizing core sealing member is arranged between an inner side wall of the accommodating groove adjacent to the E-liquid storage chamber and the atomizing core. A sealing member communicating port is formed to run through the atomizing core sealing member. The E-liquid storage chamber communicates with the atomizing core via the E-liquid storage chamber communicating port and the sealing member communicating port.

According to some embodiments of the present disclosure, the seat is provided with at least one buckle; and at least one buckling part is formed on the atomizing core fixing member. The buckle mates with the buckling part to buckle the atomizing core fixing member to the seat assembly.

According to some embodiments of the present disclosure, at least one buckling part is located on a side wall at the open side of the accommodating groove. The buckle has a free end with a buckling portion, where the buckling portion runs through the open side to abut against a side surface of the buckling part away from the seat assembly.

According to some embodiments of the present disclosure, the buckling part has a buckling part guiding face that extends obliquely towards the buckle in a direction from the seat assembly to a center of the shell. The buckling portion has a first buckle guiding face that extends obliquely away from the buckling part in the direction from the seat assembly to the center of the shell.

According to some embodiments of the present disclosure, the buckle has a second buckle guiding face that is located at a side of the buckle away from the buckling portion, and extends obliquely towards the buckling part in the direction from the seat assembly to the center of the shell.

According to some embodiments of the present disclosure, at least one reinforcing rib is arranged at the side of the buckle away from the buckling portion.

According to some embodiments of the present disclosure, a plurality of reinforcing ribs are provided, which are arranged at intervals and connected to the seat assembly.

According to some embodiments of the present disclosure, a ventilation groove is formed on the atomizing core fixing member. The ventilation channel is defined between the ventilation groove and the atomizing core. A width of the ventilation groove is $W_1$, and a depth of the ventilation groove is $H_1$, in which $W_1$ and $H_1$ meet respectively: 0.25 mm≤$W_1$≤0.5 mm, and 0.1 mm≤$H_1$≤0.4 mm.

According to some embodiments of the present disclosure, the accommodating groove includes a bottom wall, and a side wall connected to an outer peripheral side of the bottom wall. The ventilation groove includes: a first ventilation groove, formed on the bottom wall, and having at least one first ventilation port communicating with the E-liquid storage chamber; and at least one second ventilation groove, formed on the side wall, communicating with the first ventilation groove and the atomizing chamber respectively, and having a depth greater than the depth of the first ventilation groove.

According to some embodiments of the present disclosure, a cross-sectional area of the second ventilation groove gradually decreases in a direction toward the E-liquid storage chamber.

According to some embodiments of the present disclosure, a bottom wall of the second ventilation groove extends obliquely in the direction toward the E-liquid storage chamber and a direction toward the center of the atomizing core.

According to some embodiments of the present disclosure, the first ventilation groove extends along a circumferential direction of the E-liquid storage chamber communicating port. The first ventilation port runs through the side wall of the E-liquid storage chamber communicating port in the thickness direction of the housing. The second ventilation groove is located on the side wall of the accommodating groove in the width direction of the housing. According to some embodiments of the present disclosure, wherein the ventilation groove further includes: at least one ventilation communicating section, formed on the bottom wall, one end of the ventilation communicating section is in communication with the first ventilation groove and the other end extends into the second ventilation groove and communicates with the second ventilation groove, and an edge of the ventilation communicating section is joined to an inner wall of the second ventilation groove.

According to some embodiments of the present disclosure, a seat sealing member is located between the atomizing core fixing member and the seat.

According to some embodiments of the present disclosure, the seat sealing member includes: a first seat sealing section, located between the atomizing core fixing member and the seat assembly; and a second seat sealing section, connected to the first seat sealing section, and located between an outer peripheral surface of the seat assembly and an inner peripheral surface of the shell.

According to some embodiments of the present disclosure, at least one E-liquid storage groove is formed on the atomizing core fixing member. A width of the E-liquid storage groove is $W_2$, and a depth of the E-liquid storage groove is $H_2$, in which $W_2$ and $H_2$ meet respectively: 0.25 mm$\leq W_2 \leq$0.5 mm, and 0.1 mm$\leq H_2 \leq$0.4 mm.

According to some embodiments of the present disclosure, the width of the E-liquid storage groove gradually increases in a direction from a bottom of the E-liquid storage groove to an opening of the E-liquid storage groove.

According to some embodiments of the present disclosure, a plurality of E-liquid storage grooves are provided. The plurality of E-liquid storage grooves include: at least one first E-liquid storage groove, extending along the length direction of the housing; and at least one second E-liquid storage groove, extending along the width direction of the housing.

According to some embodiments of the present disclosure, a plurality of convex ribs are arranged on an outer surface of the atomizing core fixing member. The plurality of convex ribs include: a plurality of first convex ribs, arranged at intervals along the width direction of the housing and extending along the length direction of the housing, where the first E-liquid storage groove is defined between two adjacent first convex ribs; and a plurality of second convex ribs, arranged at intervals along the length direction of the housing and extending along the width direction of the housing, where the second E-liquid storage groove is defined between at least two adjacent second convex ribs.

According to some embodiments of the present disclosure, at least a portion of two adjacent second convex ribs overlap in the length direction of the housing.

According to some embodiments of the present disclosure, wherein an atomizing chamber communicating port and an accommodating groove are formed on at least a side surface of the atomizing core fixing member in the thickness direction of the housing, wherein the atomizing chamber communicating port runs through a side wall of the atomizing core fixing member; the accommodating groove is located at a side of the atomizing chamber communicating port adjacent to the E-liquid storage chamber and communicates with the atomizing chamber communicating port; the plurality of first convex ribs and the plurality of second convex ribs are located in the accommodating groove; and a stop rib is located in the accommodating groove, the stop rib is joined to a side edge of the atomizing chamber communicating port adjacent to the E-liquid storage chamber, and one end of the stop rib is connected to one side wall of the accommodating groove in the width direction of the housing and the other end of the stop rib is spaced apart from the other side wall of the accommodating groove in the width direction of the housing.

According to some embodiments of the present disclosure, wherein the accommodating groove includes an accommodating groove communicating port, the accommodating groove communicating port runs through a side wall of the atomizing chamber communicating port, and the accommodating groove communicating port is located below the stop rib.

According to some embodiments of the present disclosure, a plurality of atomization guide channels are provided. Each of the atomization guide channels has one end communicating with the atomizing chamber and another end communicating with the aerosol passage. A partition is arranged between the other ends of the plurality of atomization guide channels and the aerosol passage. The partition is configured to space apart the other ends of the plurality of atomization guide channels and directs a gas flow from the plurality of atomization guide channels to the aerosol passage.

According to some embodiments of the present disclosure, wherein the at least one atomization guide channel includes a plurality of atomization guide channels, wherein one end of each of the atomization guide channels is in communication with the atomizing chamber and another end is in communication with the aerosol passage; and wherein a partition is located between the other ends of the plurality of atomization guide channels and the aerosol passage, which is configured to separate the other ends of the plurality of atomization guide channels and direct a gas flow from the plurality of atomization guide channels to the aerosol passage.

According to some embodiments of the present disclosure, wherein the aerosol passage extends in the length direction of the housing, and the atomization communicating channel includes a first communicating channel section and a second communicating channel section connected sequentially toward a direction away from the aerosol passage in the length direction of the housing, wherein one end of the aerosol passage is located in the first communicating channel section, and the partition is located in the second communicating channel section.

According to some embodiments of the present disclosure, the atomizer for the electronic cigarette further includes: an atomizing core fixing and sealing member. The atomizing core fixing and sealing member is located on the atomizing core fixing member, and at least partially located between the atomizing core fixing member and the inner wall of the housing and between an outer peripheral surface of the aerosol passage and an inner wall of the first communicating channel section.

According to an embodiment in a second aspect of the present disclosure, a cartridge includes the atomizer for the electronic cigarette according to the embodiment in the first aspect of the present disclosure.

According to an embodiment in a third aspect of the present disclosure, an electronic cigarette includes the atomizer for the electronic cigarette according to the embodiment in the first aspect of the present disclosure or the cartridge according to the embodiment in the second aspect of the present disclosure.

The additional aspects and advantages of the present disclosure will be set forth in part in the description below, parts of which will become apparent from the description below, or will be understood by the practice of the present disclosure.

BRIEF DESCRIPTION OF THE DRAWINGS

The above and/or other additional aspects and advantages of the present disclosure become apparent and comprehensible from the description of embodiments in connection with accompanying drawings, in which.

LIST OF REFERENCE NUMERALS

100: atomizer;

1: housing; 11: E-liquid storage chamber; 12: aerosol passage; 13: atomizing chamber; 14: shell;

141: inspiratory mouth; 15: seat assembly; 151: seat; 1511: gas intake passage;

1512: support member; 1513: buckle; 1514: buckling portion; 1515: first buckle guiding face;

1516: second buckle guiding face; 1517: reinforcing rib; 152: seat shell; 1521: gas inlet;

153: communicating channel; 2: atomizing core fixing member; 21: atomization guide channel; 22: accommodating groove;

221: E-liquid storage chamber communicating port; 23: buckling part; 231: buckling part guiding face; 24: ventilation groove;

241: first ventilation groove; 2411: first ventilation port; 242: second ventilation groove; 243: ventilation communicating section;

25: E-liquid storage groove; 251: first E-liquid storage groove; 252: second E-liquid storage groove; 26: first convex rib;

27: second convex rib; 28: atomizing chamber communicating port; 29: accommodating groove; 291: stop rib;

292: accommodating groove communicating port; 30: atomization communicating channel; 301: first communicating channel section;

302: second communicating channel section; 3: atomizing core; 31: groove; 4: gas resistance adjusting member;

41: communicating hole; 5: electrically conductive member; 6: atomizing core sealing member; 61: sealing member communicating port;

7: seat sealing member; 71: first seat sealing section; 72: second seat sealing section;

8: partition; 9: atomizing core fixing and sealing member; 91: first sealing section; 92: second sealing section;

93: third sealing section.

DETAILED DESCRIPTION

The embodiments of the present disclosure are described in detail below, and the embodiments described with reference to accompanying drawings are exemplary. Hereinafter, an atomizer 100 for an electronic cigarette according to an embodiment of the first aspect of the present disclosure will be described with reference to FIGS. 1 to 18.

Figure 1:
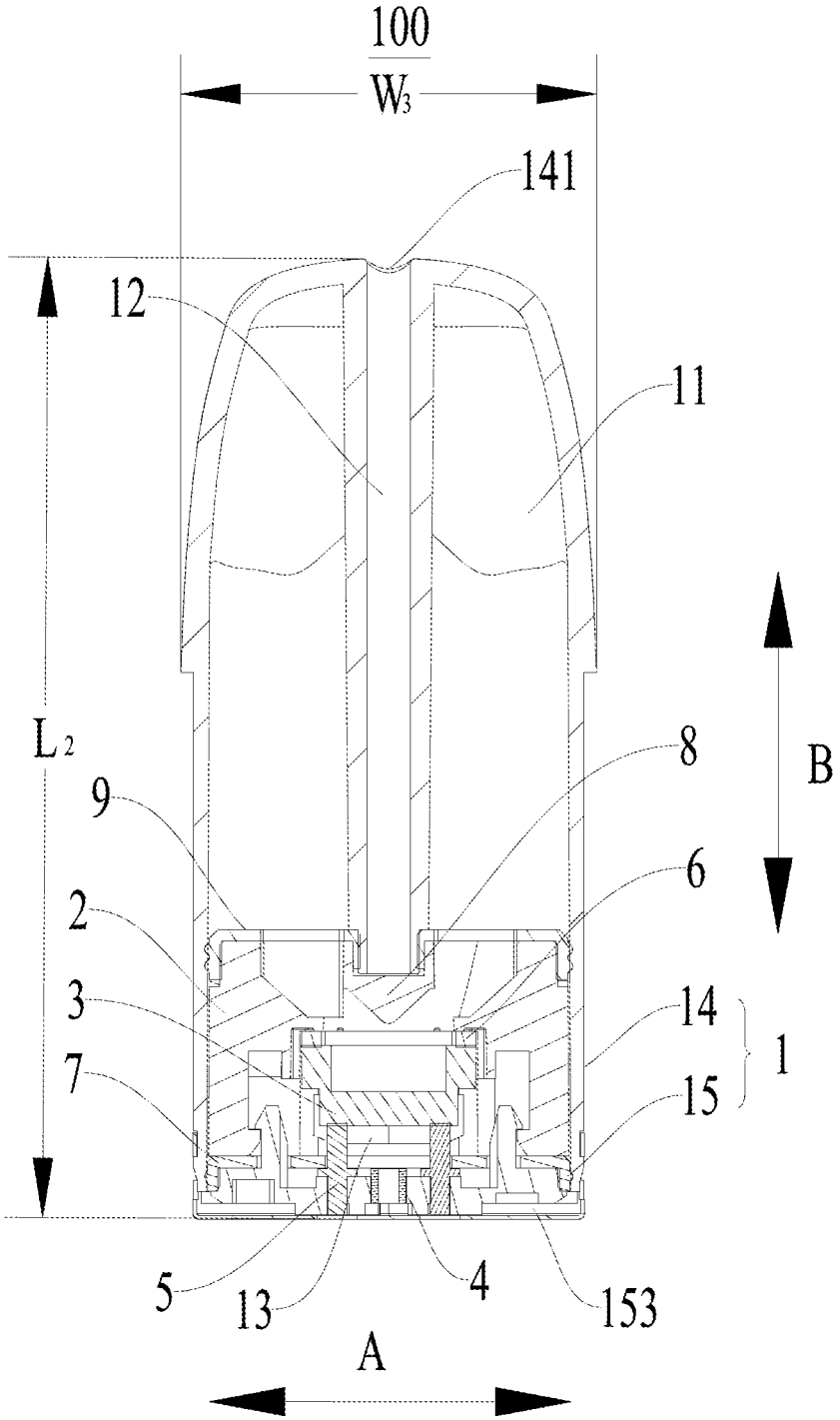
FIG. 1 is a cross-sectional view of an atomizer according to an embodiment of the present disclosure.
Figure 2:
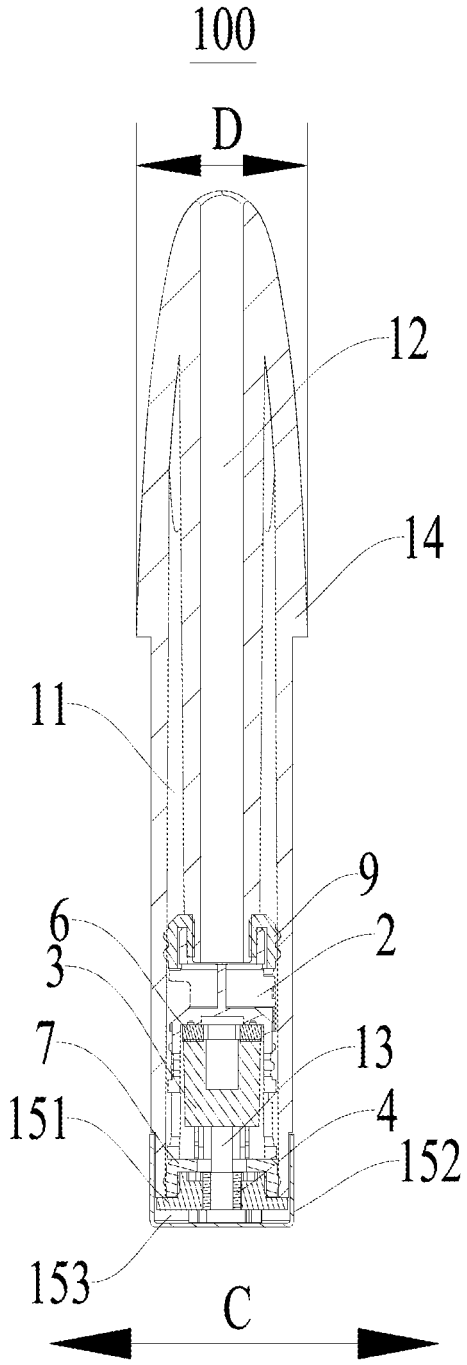
FIG. 2 is a cross-sectional view of an atomizer according to an embodiment of the present disclosure viewed from another perspective.
Figure 3:
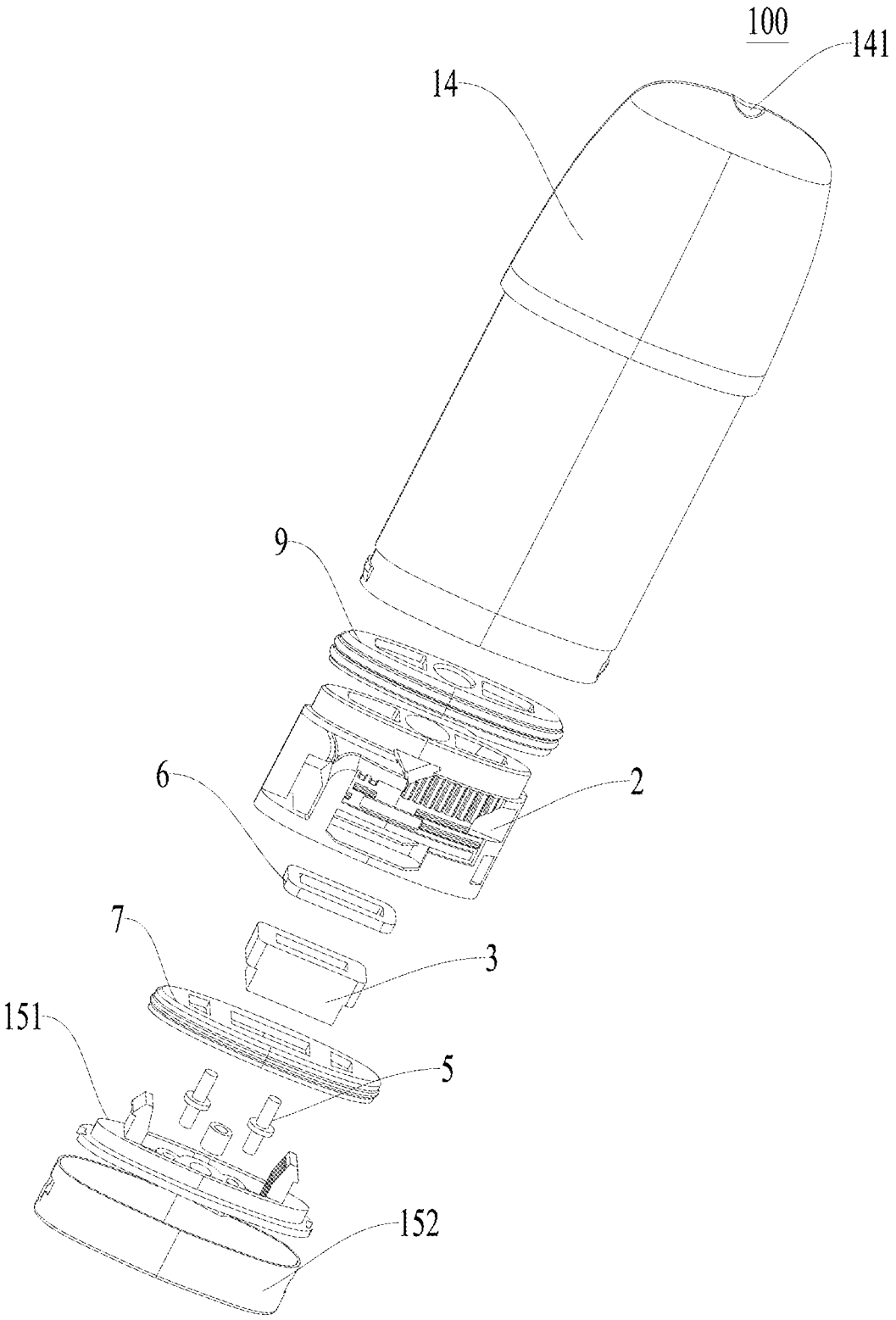
FIG. 3 is an exploded view of an atomizer according to an embodiment of the present disclosure.
Figure 4:
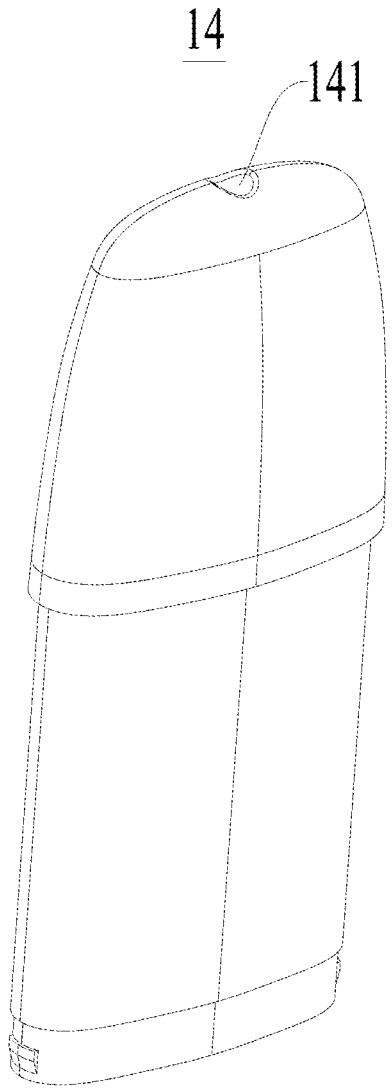
FIG. 4 is a schematic view of a shell of the atomizer shown in FIG. 3.
Figure 5:
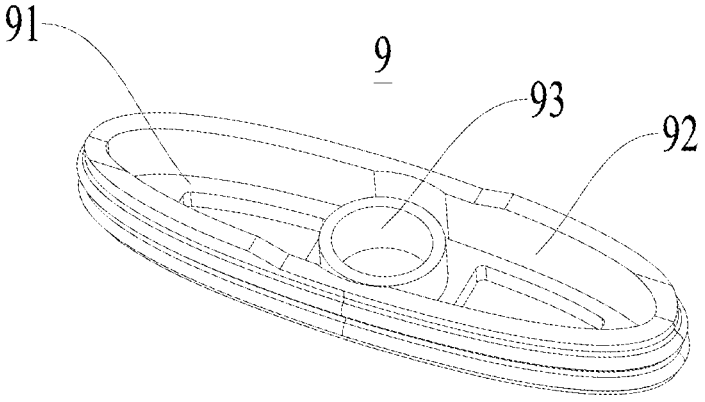
FIG. 5 is a schematic view of an atomizing core sealing member of the atomizer shown in FIG. 3.
Figure 6:
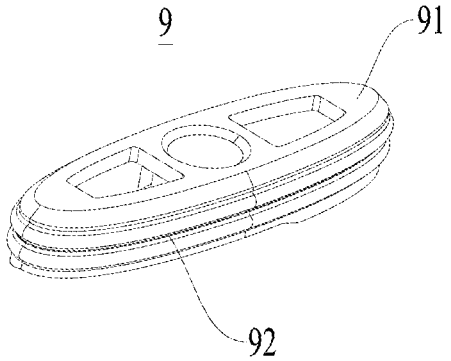
FIG. 6 is a schematic view of an atomizing core sealing member of the atomizer shown in FIG. 3 viewed from another perspective.

As shown in FIGS. 1 to 3, the battery 100 for an electronic cigarette according to an embodiment of the first aspect of the present disclosure includes a housing 1 and an atomizing core fixing member 2.

In one embodiment, an E-liquid storage chamber 11, an aerosol passage 12, and an atomizing chamber 13 communicating with the aerosol passage 12 are arranged in the housing 1. At least one gas inlet 1521 communicating with the atomizing chamber 13 and an inspiratory mouth 141 communicating with the aerosol passage 12 are provided at the housing 1. The gas inlet 1521 is located on a side surface of the housing 1. The housing 1 has a length direction (indicated by arrow A), a width direction (indicated by arrow B), and a thickness direction (indicated by arrow C) The atomizing core fixing member 2 is arranged in the housing 1, and the atomizing core fixing member 2 spaces apart the E-liquid storage chamber 11 and the atomizing chamber 13. The atomizing core fixing member 2 is provided with an atomizing core, communicating with the E-liquid storage chamber 11 and the atomizing chamber 13 respectively and configured to atomize a medium to be atomized in the E-liquid storage chamber 11.

For example, as illustrated in FIGS. 1 to 3, the aerosol passage 12 is formed in the middle of the housing 1, the E-liquid storage chamber 11 is arranged around the aerosol passage 12, the atomizing chamber 13 is located below the E-liquid storage chamber 11, and the atomizing core is arranged between the E-liquid storage chamber 11 and the atomizing chamber 13. The E-liquid storage chamber 11 is configured to hold the medium to be atomized, for example, E-liquid, and the atomizing core is configured to atomize the medium to be atomized to form smoke (including, but not limited to, an aerosol, a suspended liquid, low-temperature vapor and a volatile gas). The gas inlet 1521 may be formed on an outer peripheral side of the housing 1, that is, the gas inlet 1521 may be formed on an outer peripheral surface of the housing 1, and the gas inlet 1521 communicates with the atomizing chamber 13. Because an amount of the E-liquid can be stored at a bottom of the housing 1, the gas inlet 1521 arranged on the outer peripheral surface of the housing 1 can avoid the leakage of the E-liquid in the atomizing chamber 13, thus improving the user experience.

Figure 7:
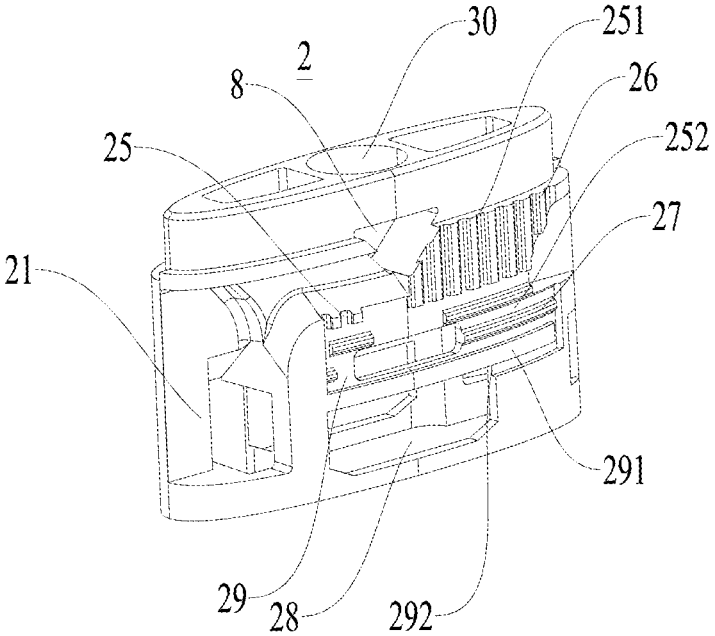
FIG. 7 is a schematic view of an atomizing core fixing member of the atomizer shown in FIG. 3.
Figure 8:
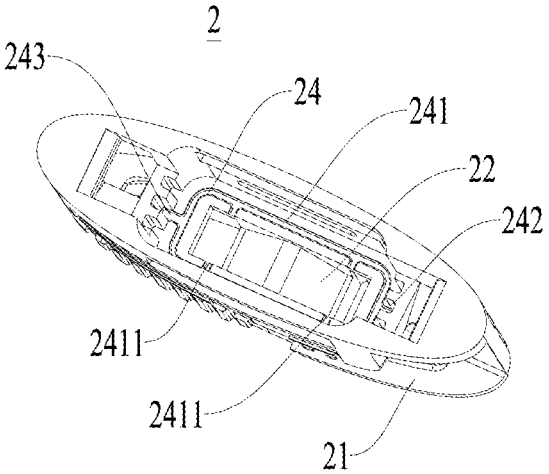
FIG. 8 is a schematic view of an atomizing core fixing member of the atomizer shown in FIG. 3 viewed from another perspective.

Referring to FIGS. 7 and 8 in conjunction with FIGS. 1 and 2, at least one atomization guide channel 21 spaced apart from the E-liquid storage chamber 11 and bringing the aerosol passage 12 and the atomizing chamber 13 into communication is defined between the atomizing core fixing member 2 and an inner wall of the housing 1. When the atomizer 100 operates, an atomized medium mixture in the atomizing chamber 13 can flow via the atomization guide channel 21 to the aerosol passage 12, and flow to a user's mouth via the inspiratory mouth 141. As shown in FIGS. 1 and 2, the dimension of the housing 1 in the thickness direction is D, the dimension of the housing 1 in the length direction is L, and the dimension of the housing 1 in the width direction is W, in which D, L and W meet: $L>W\geq D$, $5\leq L/D\leq 9$, and $2\leq W/D\leq 5$. For example, when $L/D<5$ or $W/D<2$, the dimension of the housing 1 in the thickness direction is large, which increases the volume of the atomizer 100 and goes against the ultrathin design of the atomizer 100. When $L/D>9$ or $W/D>5$, the dimension of the housing 1 in the thickness direction is small, causing a small internal space of the housing 1. This requires a small dimension of other elements, for example, the atomizing core fixing member 2, in the housing 1, thus increasing the processing difficulty and causing inconvenience to the assembly of the atomizer 100. Therefore, when D, L and W meet: $5\leq L/D\leq 9$ and $2\leq W/D\leq 5$, the atomizer 100 can have an ultrathin design, and is convenient in processing, thus improving the assembly efficiency of the atomizer 100.

The housing 1 meets $L>W\geq D$. That is, the dimension of the housing 1 in the length direction is greater than the dimensions of the housing 1 in the width direction and the thickness direction, and the dimension of the housing 1 in the width direction is greater than or equal to the dimension of the housing 1 in the thickness direction. When the dimension of the housing 1 in the width direction is greater than the dimension of the housing 1 in the thickness direction, the maximal dimension of the housing 1 in the thickness direction C is the smallest, the housing 1 has a flat shape, and the maximal dimension of the housing 1 in the length direction A is greater than the maximal dimension of the housing 1 in the width direction B. When the atomizer 100 is used as a cartridge in an electronic cigarette, the length direction A is generally consistent with the length direction of the cigarette rod, that is, the length direction A extends from the cartridge to the cigarette rod.

Hereinafter, an operation process when the atomizer 100 is used in an electronic cigarette will be described by way of example.

After the atomizer 100 is assembled with the cigarette rod, the cigarette is puffed by a user via the inspiratory mouth 141. This is sensed by a pneumatic sensor (for example, microphone) in the cigarette rod, such that a power source in the cigarette rod is enabled and electrically connected to the atomizing core. The atomizing core operates, for example, to generate heat, and the medium to be atomized, for example, the E-liquid, in the E-liquid storage chamber 11 moves toward the atomizing chamber 13 and heated by the atomizing core to form the smoke in the atomizing chamber 1313. Meanwhile, the external air enters the atomizing chamber 13 through the gas inlet 1521 and is mixed with the smoke in the atomizing chamber 13. The mixed smoke is puffed by the user from the inspiratory mouth 141 through the atomization guide channel 21 and the aerosol passage 12, to meet the user's needs during use. When the user stops puffing from the inspiratory mouth 141, the medium to be atomized, for example, the E-liquid, in the E-liquid storage chamber 11 does not enter the atomizing chamber 13 from the atomizing core any more, to avoid the ineffective consumption of the medium to be atomized in the E-liquid storage chamber 11, and improve the utilization of the medium to be atomized. It is to be noted that in some electronic cigarettes, the atomizer 100 and the cigarette rod are arranged to have separate structures, and assembled detachably; and in some electronic cigarettes, the atomizer 100 and the cigarette rod are arranged to have a non-detachable structure, which are not particularly limited herein.

According to the atomizer 100 in accordance with the embodiment of the present disclosure, the gas inlet 1521 is arranged on the side surface of the housing 1, a ventilation channel is arranged between the atomizing core fixing member 2 and the atomizing core, the ventilation channel communicates with the E-liquid storage chamber 11 and the atomizing chamber 13 respectively, and D, L and W meet: $L>W\geq D$, $5\leq L/D\leq 9$, and $2\leq W/D\leq 5$. Therefore, compared with a conventional atomizer, the technicians of the present disclosure find through many experiments that by a size design of the cartridge as described above, the internal space in the electronic cigarette can be fully utilized, and the electronic cigarette can be designed to be ultra-thin maximally while a small draw resistance is ensured. That is, the atomizer 100 can be designed to be ultra-thin, so as to provide a good experience when being grasped, carried and puffed by users.

According to some embodiments of the present disclosure, as shown in FIG. 2, D further meets: $5.0\ mm\leq D\leq 9.0\ mm$. When $D<5.0$ mm, the thickness of the housing 1 is small, causing a reduced internal space of the housing 1. This requires a small size of other elements, for example, the atomizing core fixing member 2, in the housing 1, thus increasing the processing difficulty, and causing a high difficulty in the assembly of the atomizing core and a reduced overall atomization efficiency of the electronic cigarette. When $D>9.0$ mm, the thickness of the housing 1 is large, and the user experience is poor when the electronic cigarette is grasped and puffed by the user. Therefore, by setting D to meet: $5.0\ mm\leq D\leq 9.0\ mm$, the atomizer 100 can achieve an ultra-thin design required by the users and the assembly efficiency of the atomizer 100 can be improved, while the processing difficulty is reduced and the atomization efficiency is ensured. Further, D further meets: 6.0 mm≤D≤8.0 mm.

Figure 10:
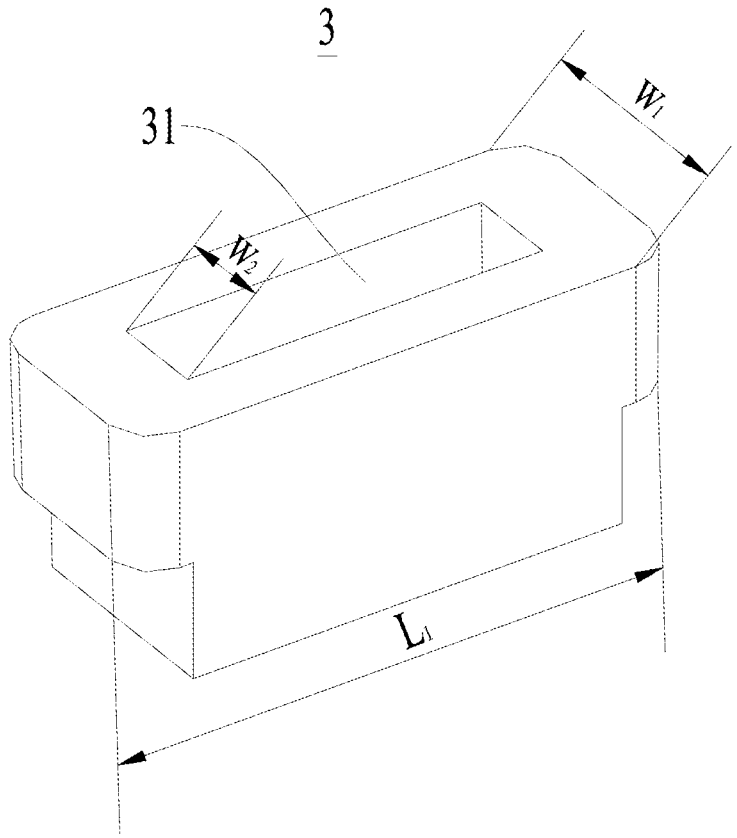
FIG. 10 is a schematic view of an atomizing core of the atomizer shown in FIG. 3.
Figure 11:
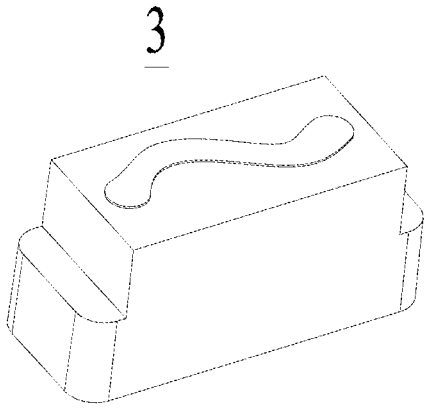
FIG. 11 is a schematic view of an atomizing core of the atomizer shown in FIG. 3 viewed from another perspective.
Figure 12:
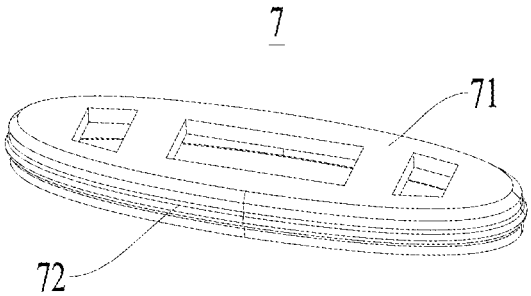
FIG. 12 is a schematic view of a seat sealing member of the atomizer shown in FIG. 3.
Figure 13:
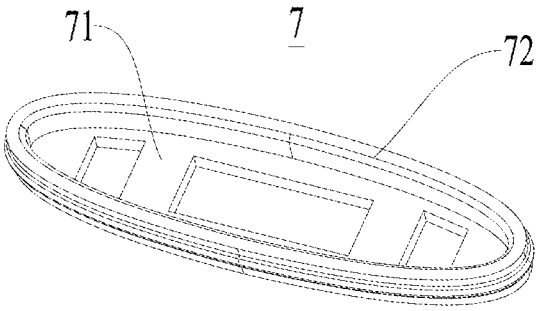
FIG. 13 is a schematic view of a seat sealing member of the atomizer shown in FIG. 3 viewed from another perspective.

According to some embodiments of the present disclosure, as shown in FIG. 10, the dimension of the atomizing core 3 in the width direction of the housing 1 is the length $L_1$ of the atomizing core 3, and the dimension of the atomizing core 3 in the thickness direction of the housing 1 is the width $w_1$ of the atomizing core 3, in which $L_1$ and $w_1$ meet: $2 \le L_1/w_1 \le 5$. If $L_1/w_1$ is greater than 5, the dimension of the atomizing core 3 in the width direction is relatively small, possibly causing a small size of a groove 31. Therefore, when the medium to be atomized in the E-liquid storage chamber 11 is atomized by the atomizing core 3, the medium to be atomized is not facilitated to enter the groove 31, and the atomization effect may be poor. If $L_1/w_1$ is less than 2, the dimension of the atomizing core 3 in the width direction is relatively large, possibly causing a large thickness of the atomizer 100, and going against the thinning design of the atomizer 100. Therefore, by setting the L1/w1 ratio to meet $2 \le L_1/w_1 \le 5$, the atomizer 100 can be designed to have a much smaller thickness while the atomizer 100 is ensured to have a good atomization effect.

According to some embodiments of the present disclosure, referring to FIG. 10, the dimension of the atomizing core 3 in the thickness direction of the housing 1 is the width $w_1$ of the atomizing core 3, in which $w_1$ meets: 2 mm≤$w_1$≤3.5 mm. If $w_1$ is greater than 3.5 mm, the dimension of the atomizing core 3 in the width direction is large, possibly causing a large thickness of the atomizer 100, and increasing the thickness of the atomizer 100. If $w_1$ is smaller than 2 mm, the dimension of the atomizing core 3 in the width direction is small, possibly causing a small size of the groove 31. Therefore, when the medium to be atomized in the E-liquid storage chamber 11 is atomized by the atomizing core 3, the medium to be atomized is not facilitated to enter the groove 31, and the atomization effect may be poor. Therefore, by setting $w_1$ to meet 2 mm≤$w_1$≤3.5 mm, the atomizer 100 can be designed to have a much smaller thickness while the atomization effect of the atomizer 100 is ensured.

According to some embodiments of the present disclosure, the groove 31 is formed on a side surface of the atomizing core facing the E-liquid storage chamber 11, and the thickness of the atomizing core at a position corresponding to a bottom wall of the groove 31 is $t_1$, in which $t_1$ meets: 0.6 mm≤$t_1$≤2.5 mm. If $t_1$<0.6 mm, the thickness of the atomizing core at the position corresponding to the bottom wall of the groove 31 is small, so that the mechanical strength of the atomizing core at the position corresponding to the bottom wall of groove 31 is weak. As a result, when the medium to be atomized in the E-liquid storage chamber 11 is atomized by the atomizing core, the portion of the atomizing core corresponding to the bottom wall of the groove 31 may be deformed or cracked, reducing the safety performance of the atomizer 100. If $t_1$>2.5 mm, the thickness of the atomizing core corresponding to the bottom wall of the groove 31 is large, so the medium to be atomized is difficult to penetrate the portion of the atomizing core corresponding to the bottom wall of the groove 31, causing a reduced atomization efficiency of the atomizer 100. Therefore, by setting $t_1$ to meet 0.6 mm≤$t_1$≤2.5 mm, the safe use of the atomizer 100 is ensured while the atomization efficiency of the atomizer 100 is improved.

According to some embodiments of the present disclosure, the thickness of the atomizing core at a position corresponding to a side wall of the groove 31 is $t_2$, in which $t_2$ meets: 0.6 mm≤$t_2$≤1.5 mm. If $t_2$<0.6 mm, the thickness of the atomizing core at the position corresponding to the side wall of the groove 31 is small, and the medium to be atomized may be not atomized fully. If $t_2$>1.5 mm, the thickness of the atomizing core at the position corresponding to the side wall of the groove 31 is large, the medium to be atomized cannot pass through the atomizing core easily, and the atomization efficiency is reduced. Therefore, by setting $t_2$ to meet 0.6 mm≤$t_2$≤0.5 mm, full atomization is effectively guaranteed, and the atomization efficiency of the atomizer 100 is improved.

According to some embodiments of the present disclosure, as shown in FIG. 10, the thickness of the atomizing core 3 at the position corresponding to the side wall of the groove 31 is $t_2$, in which $w_1$ and $t_2$ meet: $2.5 \le w_1/t_2 \le 6$. If $w_1/t_2$ is greater than 6, the ratio of the thickness of the atomizing core 3 at the position corresponding to the side wall of the groove 31 to the width of the atomizing core 3 is small, and the thickness of the atomizing core 3 at the position corresponding to the side wall of the groove 31 is small. As a result, when the medium to be atomized in the E-liquid storage chamber 11 is atomized by the atomizing core 3, the portion of the atomizing core 3 corresponding to the side wall of the groove 31 may be deformed or cracked, reducing the safety performance of the atomizer 100. If $w_1/t_2$ is less than 2.5, the ratio of the thickness of the atomizing core 3 at the position corresponding to the side wall of the groove 31 to the width of the atomizing core 3 is large, and the thickness of the atomizing core 3 at the position corresponding to the side wall of the groove 31 is large. As a result, the medium to be atomized cannot pass through the atomizing core 3 easily, and the atomization efficiency is reduced. By setting $w_1$ and $t_2$ to meet $2.5 \le w_1/t_2 \le 6$, the ratio of the width of the atomizing core 3 to the thickness of the atomizing core 3 at the position corresponding to the side wall of the groove 31 is appropriate, so the atomizer 100 has a high atomization efficiency and a good safety performance.

According to some embodiments of the present disclosure, referring to FIG. 10, the dimension of the groove 31 in the thickness direction of the housing 1 is the width $w_2$ of the groove 31, in which $w_1$ and $w_2$ meet: $1.5 \le w_1/w_2 \le 6$. If $w_1/w_2$ is greater than 6, the ratio of the groove 31 in the width direction of the atomizing core 3 is small, and the thickness of the atomizing core 3 at the position corresponding to the side wall of the groove 31 is large. As a result, the medium to be atomized cannot pass through the atomizing core 3 easily, and the atomization efficiency is reduced. If $w_1/w_2$ is less than 1.5, the ratio of the groove 31 in the width direction of the atomizing core 3 is large, the thickness of the atomizing core 3 at the position corresponding to the side wall of the groove 31 is small, and the mechanical strength of the atomizing core 3 at the position corresponding to the bottom wall of groove 31 may be weak. As a result, when the medium to be atomized in the E-liquid storage chamber 11 is atomized by the atomizing core 3, the portion of the atomizing core 3 corresponding to the side wall of the groove 31 may be deformed or cracked, reducing the safety performance of the atomizer 100. By setting $w_1$ and $w_2$ to meet $1.5 \le w_1/w_2 \le 6$, the ratio of the width of the atomizing core 3 to the width of the groove 31 is appropriate, so the atomizer 100 has a high atomization efficiency and a good safety performance.

According to some embodiments of the present disclosure, referring to FIGS. 3, 4, 17 and 18, the housing 1 includes a shell 14 and a seat assembly 15. The shell 14 has one open end, and the inspiratory mouth 141 is formed at the other end of the shell 14. The seat assembly 15 is arranged at the open end of the shell 14, where the E-liquid storage chamber 11, the aerosol passage 12 and the atomizing chamber 13 are defined between the seat assembly 15 and the shell 14. The seat assembly 15 includes a seat 151 and a seat shell 152 arranged at a side of the seat 151 away from a center of the housing 1. The gas inlet 1521 is formed on a side surface of the seat shell 152, and a gas intake passage 1511 bringing the gas inlet 1521 and the atomizing chamber 13 into communication is formed on the seat 151.

As shown in FIGS. 3, 4, 17 and 18, one end of the shell 14 in the length direction is open, and the inspiratory mouth 141 is formed at the other end of the shell 14 in the length direction. The seat assembly 15 is located at the open side of the shell 14, the gas intake passage 1511 can be formed in the middle of the seat 151, and the gas intake passage 1511 extends along the length direction of the housing 1. The seat shell 152 can be sheathed on the open side of the shell 14 through a buckle 1513 to limit the seat 151 in the shell 14. Since the seat shell 152 has a small wall thickness, the processing of the gas inlet 1521 is facilitated by arranging the gas inlet 1521 on the side surface of the seat shell 152. When the atomizer 100 operates, the external air can flow to the atomizing chamber 13 through the gas inlet 1521 and the gas intake passage 1511, and is mixed with the atomized medium in the atomizing chamber 13.

Further, a ventilation channel is provided between the atomizing core fixing member 2 and the atomizing core, and the ventilation channel communicates with the atomizing chamber 13 and the E-liquid storage chamber 11 respectively. Because the medium to be atomized in the E-liquid storage chamber 11 continuously flows to the atomizing core when the atomizer 100 operates, the E-liquid storage chamber 11 is in a negative pressure state. In this case, the pressure in the E-liquid storage chamber 11 is lower than that in the atomizing chamber 13, so that the gas in the atomizing chamber 13 flows toward the ventilation channel and flows via the ventilation channel into the E-liquid storage chamber 11, to achieve a pressure balance between the E-liquid storage chamber 11 and the atomizing chamber 13. Therefore, the medium to be atomized in the E-liquid storage chamber 11 can continuously move into the atomizing chamber 13 through the atomizing core, so that the atomizing core can acquire enough medium to be atomized to keep the smoke generation effect.

According to some embodiments of the present disclosure, by providing the ventilation channel having the structure as described above, a pressure difference between the E-liquid storage chamber 11 and the atomizing chamber 13 can be adjusted by the ventilation channel, to achieve pressure balance between the E-liquid storage chamber 11 and the atomizing chamber 13, ensure the smooth transfer of the E-liquid to the atomizing core, and well prevent the leakage of the E-liquid.

According to some embodiments of the present disclosure, as shown in FIG. 1, a side surface of the seat 151 away from the E-liquid storage chamber 11 is at least partially spaced apart from an inner wall of the seat shell 152 to define at least one communicating channel 153. The gas inlet 1521 is brought into communication with the gas intake passage 1511 through the communicating channel 153. In such an arrangement, the communicating channel 153 plays a guiding role. The external air can flow to the communicating channel 153 through the gas inlet 1521, and then the air is guided by the communicating channel 153 to flow quickly and smoothly to the gas intake passage 1511.

Still further, the side surface of the seat 151 away from the E-liquid storage chamber 11 is provided with at least one support member 1512. The support member 1512 abuts against the inner wall of the seat shell 152, and at least a portion of an outer peripheral surface of the support member 1512 is spaced apart from an inner peripheral surface of the seat shell 152 to define the communicating channel 153. For example, in the embodiments shown in FIGS. 1, 14, 15 and 16, a side surface of the support member 1512 away from the E-liquid storage chamber 11 bulges from the side surface of the seat 151 away from the E-liquid storage chamber 11. During installation, the side surface of the support member 1512 away from the E-liquid storage chamber 11 abuts against the inner wall of the seat shell 152. In this case, the inner peripheral surface of the seat shell 152, the side surface of the seat 151 away from the E-liquid storage chamber 11, and the outer peripheral surface of the support member 1512 away from the gas intake passage 1511 define the communicating channel 153. Accordingly, the communicating channel 153 has a simple structure and is convenient for processing. Moreover, the support member 1512 can serve as the reinforcing rib 1517, to improve the structural strength of the seat 151.

According to some embodiments of the present disclosure, multiple gas inlets 1521 are provided, which are respectively located at two sides of the housing 1 in the width direction. In the description of the disclosure, "multiple" means two or more. Referring to 1, two gas inlets 1521 may be provided, which are respectively located at two sides of the housing 1 in the width direction of the housing 1, and symmetrical about a central axis of the housing 1. By arranging the multiple gas inlets 1521, the air volume in the atomizing chamber 13 can be further increased, so that the atomized medium can be mixed with air in a short time, to further improve the user experience.

FIG. 1 shows two gas inlets 1521 for the purpose of exemplary illustration. However, it is to be understood by those of ordinary skill in the art from reading the technical solution of the present disclosure that the embodiment where three or more gas inlets 1521 are used also falls within the protection scope of the present disclosure.

Figure 14:
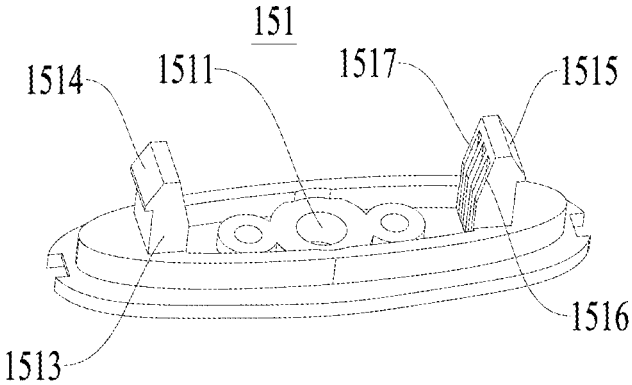
FIG. 14 is a schematic view of a seat of the atomizer shown in FIG. 3.
Figure 15:
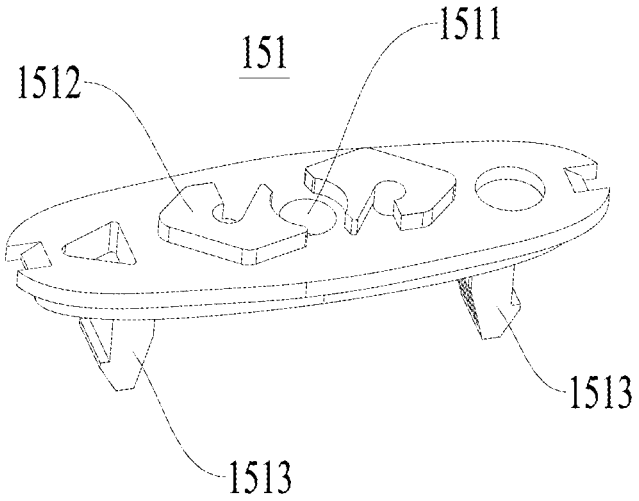
FIG. 15 is a schematic view of a seat of the atomizer shown in FIG. 3 viewed from another perspective.
Figure 16:
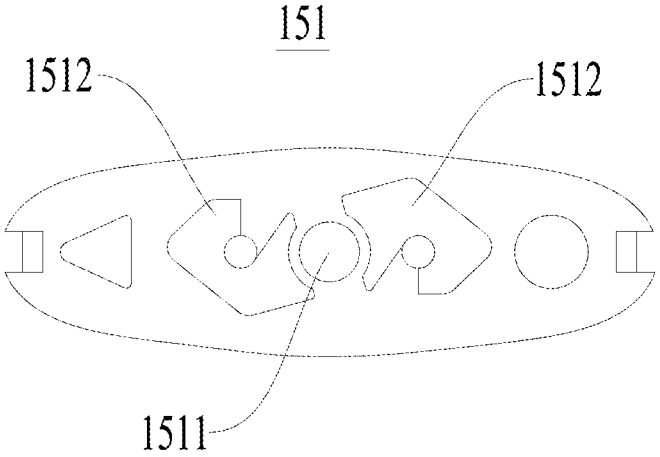
FIG. 16 is a bottom view of a seat of the atomizer shown in FIG. 3.
Figure 17:
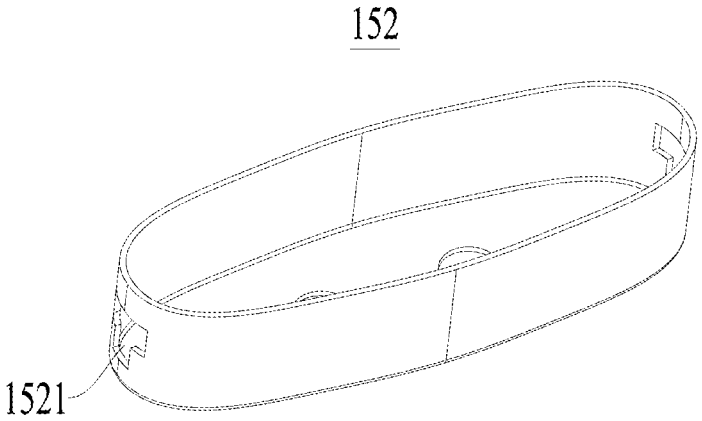
FIG. 17 is a schematic view of a seat shell of the atomizer shown in FIG. 3.
Figure 18:
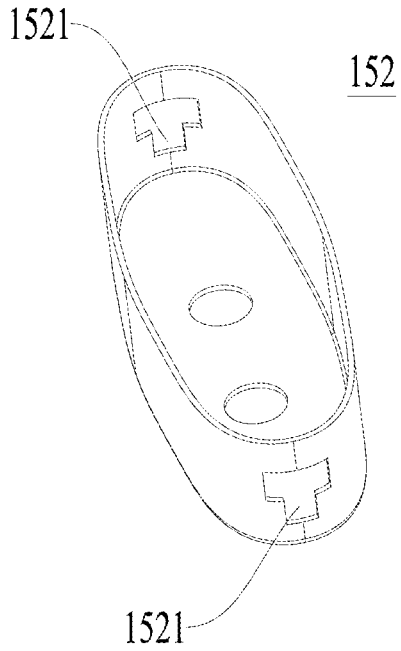
FIG. 18 is a schematic view of a seat shell of the atomizer shown in FIG. 3 viewed from another perspective.

Multiple support members 1512 are provided, which are respectively located at two sides of the seat 151 in the width direction of the housing 1. Referring to FIGS. 14, 15 and 16, two support members 1512 are provided, which are respectively located at two sides of the gas intake passage 1511 in the width direction of the housing 1. As a result, two communicating channels 153 are formed in the housing 1, and the two communicating channels 153 correspond one-to-one with the two gas inlets 1521, so that the external air can flow quickly to the gas intake passage 1511. Moreover, by arranging the multiple support members 1512, a contact area between the support members 1512 and the inner wall of the seat shell 152 can be increased, to stably mount the seat 151 in the seat shell 152.

According to some embodiments of the present disclosure, referring to FIG. 1, the atomizer 100 further includes a gas resistance adjusting member 4, arranged at the gas intake passage 1511. In an example, the gas resistance adjusting member 4 is located below the atomizing chamber 13 and communicates with the atomizing chamber 13, to facilitate the air to flow through the gas resistance adjusting member 4 into the atomizing chamber 13. Therefore, the gas resistance adjusting member 4 can be used to adjust the air intake, thus adjusting the gas resistance when the electronic cigarettes are puffed by the users. Further, atomizers 100 with different air resistance can be provided, and then electronic cigarettes with various air resistance specifications can be provided, to meet the actual needs of different users and improve the user experience in puffing.

According to some embodiments of the present disclosure, a communicating hole 41 is formed on the gas resistance adjusting member 4. The communicating hole 41 brings the gas inlet 1521 and the atomizing chamber 13 into communication, and the communicating hole 41 has an inner diameter d, in which d meets. 0.8 mm≤d≤1.5 mm. When the inner diameter of the communicating hole 41 is less than 0.8 mm, the air volume flowing into the atomizing chamber 13 is small, and the gas resistance is large during the process of puffing and using the electronic cigarette by the user, which is not conductive to the normal use of the electronic cigarette. When the inner diameter of the communicating hole 41 is larger than 1.5 mm, the air volume flowing from the communicating hole 41 into the atomizing chamber 13 is large. Therefore, the ratio of air in mixed smoke in the atomizing chamber 13 is increased, the concentration of smoke generated by the medium to be atomized is reduced, the tobacco aroma of the mixed smoke is lowered, and the gas resistance when the electronic cigarette is puffed by the user is small, thus reducing the user experience during puffing. Therefore, by setting d to meet 0.8 mm≤d≤1.5 mm, the normal use of the atomizer 100 is ensured, and the puffing effect in the users is improved. Moreover, the gas resistance adjusting member 4 can be applied to electronic cigarettes with different specifications. Atomizers 100 with different gas resistances can be obtained by providing communicating holes 41 with different inner diameters. Thus, electronic cigarettes with different gas resistances can be fabricated, to obtain diverse electronic cigarette products, and electronic cigarettes with different gas resistance specifications can be selected by users according to their own needs. In the present disclosure, description is made by way of example in which the inner diameter of the communicating hole 41 on each gas resistance adjusting member 4 is constant. It can be understood that the communicating hole 41 can also be a communicating hole 41 with an adjustable inner diameter.

According to some embodiments of the present disclosure, as shown in FIG. 1, an electrically conductive member 5 runs through the seat 151, and an accommodating groove 22 is formed on the atomizing core fixing member 2. The atomizing core is arranged in the accommodating groove 22. An E-liquid storage chamber communicating port 221 is formed at a side of the accommodating groove 22 adjacent to the E-liquid storage chamber 11. The E-liquid storage chamber 11 communicates with the atomizing core via the E-liquid storage chamber communicating port 221, so that the medium to be atomized can flow through the E-liquid storage chamber communicating port 221 to the atomizing core, and then the medium to be atomized is atomized by the atomizing core into an atomized medium. The accommodating groove 22 has an open side opened toward the atomizing chamber 13, and the atomizing core communicates with the atomizing chamber 13 through the open side. A portion of the atomizing core and the accommodating groove 22 form the atomizing chamber 13, and the atomizing core communicates with the atomizing chamber 13 through the open side.

Referring to FIG. 1, an end of the electrically conductive member 5 extends through the open side into the accommodating groove 22 and is electrically connected to the atomizing core. The atomizing core is abutted against and between an inner side wall of the accommodating groove 22 facing the E-liquid storage chamber 11 and the electrically conductive member 5, so that the atomizing core is fixed. In other words, the electrically conductive member 5 can extend through the seat 151 and is abutted against a lower surface of the atomizing core, and an upper surface of the atomizing core is abutted against the inner wall of the atomizing core fixing member 2, so as to fix and limit the atomizing core. Therefore, the movement of the atomizing core in the length direction of the housing 1 is limited, to ensure the stability of the position of the atomizing core.

Further, as shown in FIGS. 1-3, an atomizing core sealing member 6 is arranged between an inner side wall of the accommodating groove 22 adjacent to the E-liquid storage chamber 11 and the atomizing core. In other words, the atomizing core sealing member 6 is provided between an end of the atomizing core away from the electrically conductive member 5 and an inner side wall of the accommodating groove 22 adjacent to the E-liquid storage chamber communicating port 221. As a result, the leak tightness between the accommodating groove 22 and atomizing core is improved. Therefore, when the medium to be atomized flows from the E-liquid storage chamber 11 to the atomizing chamber 13, the medium to be atomized can be prevented from flowing out of a gap between the atomizing core and the atomizing core fixing member 2.

Referring to FIGS. 1 to 3, a sealing member communicating port 61 is formed to run through the atomizing core sealing member 6. The E-liquid storage chamber 11 communicates with the atomizing core via the E-liquid storage chamber communicating port 221 and the sealing member communicating port 61. Multiple sealing member communicating ports 61 can be provided, and each E-liquid storage chamber communicating port 221 corresponds to at least one sealing member communicating port 61. The medium to be atomized in the E-liquid storage chamber 11 can flow through the E-liquid storage chamber communicating port 221 and then through the sealing member communicating port 61 to the atomizing core. Therefore, the sealing member communicating port 61 is formed on the atomizing core sealing member 6, to allow the medium to be atomized to flow from the E-liquid storage chamber 11 to the atomizing core for atomization of the medium to be atomized. This increases the flowability of the medium to be atomized, to replenish the medium to be atomized in the atomizing core.

Figure 9:
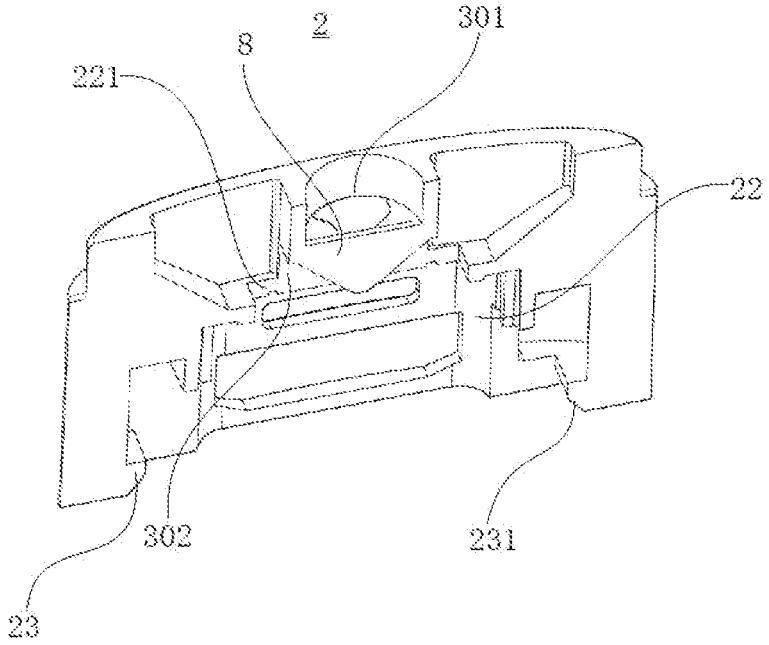
FIG. 9 is a cross-sectional view of an atomizing core fixing member of the atomizer shown in FIG. 3.

In some embodiments, referring to FIGS. 9, 15 and 16 in conjunction with FIG. 1, at least one buckle 1513 is arranged on the seat 151, and at least one buckling part 23 is formed on the atomizing core fixing member 2. The buckle 1513 mates with the buckling portion 23 to buckle the atomizing core fixing member 2 to the seat assembly 15. Therefore, the assembly of the atomizing core fixing member 2 and the seat 151 can be facilitated by arranging the buckle 1513 and the buckling part 23 that mate with each other. This connection manner is simple and convenient in operation, facilitates the manufacturing and processing of the atomizer 100 and thus the manufacturing and processing of electronic cigarettes, and reduces the production cost. In addition, by fixing the atomizing core fixing member 2 to the seat 151, the position of the atomizing core fixing member 2 is limited, effectively ensuring the atomization effect of the atomizer 100.

Further, referring to FIGS. 9, 15 and 16 in conjunction with FIG. 1, at least one buckling part 23 is arranged on a side wall at the open side of the accommodating groove 22, and the buckle 1513 has a free end with a buckling portion 1514. The buckling portion 1514 runs through the open side to abut against a side surface of the buckling part 23 away from the seat assembly 15. Therefore, it is convenient for the buckling portion 1514 to run through the open side and connect to the atomizing core fixing member 2. By arranging the buckling portion 1514 and the buckling part 23 abutting against each other, the atomizing core fixing member 2 can be tightly connected to the seat 151. The seat 151 is uneasy to fall off from the atomizing core fixing member 2, thus ensuring the normal use of the atomizer 100 and prolonging the service time of the atomizer 100.

According to some embodiments, as shown in FIG. 9, the buckling part 23 has a buckling part guiding face 231 that extends obliquely towards the buckle 1513 in a direction from the seat assembly 15 to the center of the shell 14. For example, the buckling part guiding face 231 is located at a side of the buckling part 23 away from the buckling portion 1514. During the assembly of the atomizing core fixing member 2 and the seat assembly 15, the buckling portion 1514 of the buckle 1513 abuts against the buckling part guiding face 231 and moves along the buckling part guiding face 231. The buckling portion 1514 is deformed in the direction away from the buckling part 23, to allow the bucking portion 1514 to run through the communicating port. When the buckling portion 1514 moves away from the buckling part guiding face 231, the buckling portion 1514 will move toward the bucking part 23 and abut against a surface of the bucking position 23 facing the center of the shell 14. As such, the buckle 1513 and the bucking part 23 are assembled in place, thus completing the assembly of the atomizing core fixing member 2 and the seat assembly 15. Therefore, by arranging the buckling part guide surface 231, the installation of the buckle 1513 can be guided, which facilitates the buckling portion 1514 of the buckle 1513 to conveniently run through the communicating port along the length direction of the shell 14 to mate with the buckling part 23. In this way, the assembly of the atomizing core fixing member 2 and the seat assembly 15 is facilitated, thus improving the installation efficiency of the atomizer 100.

As shown in FIGS. 15 and 16, the buckling portion 1514 has a first buckle guiding face 1515 that extends obliquely away from the buckling part 23 in a direction from the seat assembly 15 to the center of the shell 14. During the assembly of the atomizing core fixing member 2 and the seat assembly 15, the first buckle guiding face 1515 of the buckling portion 1514 faces the buckling part guiding face 231 and moves along the buckling part guiding face 231. The first buckle guiding face 1515 is deformed in the direction away from the buckling part 23, to allow the first buckle guiding face 1515 to run through the communicating port. When the first buckle guiding face 1515 moves through the communicating port and away from the buckling part guiding face 231, the first buckle guiding face 1515 will move toward the bucking position 23 and restores to an initial state. The buckling portion 1514 abuts against a surface of the bucking position 23 facing the center of the shell 14. As such, the buckle 1513 and the bucking position 23 are assembled in place, thus completing the assembly of the atomizing core fixing member 2 and the seat assembly 15. Therefore, by arranging the first buckle guiding face 1515, the buckling portion 1514 is facilitated to run through the communicating port and connect to the buckling part 23, thereby improving the assembly speed of the seat assembly 15 and the atomizing core fixing member 2. Optionally, the inclination angle of the buckling part guiding face 231 is approximately the same as that of the first buckle guiding face 1515, which facilitates the assembly of the buckle 1513 and the buckling part 23.

Further, referring to FIGS. 15 and 16, the buckle 1513 has a second buckle guiding face 1516 that is located at a side of the buckle 1513 away from the buckling portion 1514, and extends obliquely towards the buckling part 23 in a direction from the seat assembly 15 to the center of the shell 14. With this arrangement, the longitudinal section at the top of the buckle 1513 is substantially trapezoidal, which facilitates the deformation of the free end of the buckle 1513 in the assembly process. The inclined second buckle guiding face 1516 has a guiding effect on the air entering the atomizing chamber 13 from the outside, so the mixing of air and smoke atomized by the atomizing core can be well realized. In addition, the buckle 1513 with a relatively small volume can reduce the space occupied by the buckle 1513 in the atomizing chamber 13.

In some embodiments, at least one reinforcing rib 1517 is arranged at the side of the buckle 1513 away from the buckling portion 1514. For example, in the embodiments shown in FIGS. 15 and 16, the second buckle guiding face 1516 is located at a side of the reinforcing rib 1517 away from the seat assembly 15, the reinforcing rib 1517 extends in the length direction of the shell 14, and the reinforcing rib 1517 is fixedly connected to the seat assembly 15. This arrangement can improve the structural strength of the buckle 1513 and make the connection between the atomizing core fixing member 2 and the seat assembly 15 more tight.

Further, multiple reinforcing ribs 1517 are provided, which are arranged at intervals and connected to the seat assembly 15. For example, in the embodiment shown in FIG. 15, multiple reinforcing ribs 1517 are arranged at intervals in the thickness direction of the housing 1. Therefore, by arranging the above-mentioned multiple reinforcing ribs 1517, the buckle 1513 is allowed to have a certain deformation capacity while the structural strength of the buckle 1513 is ensured to be improved, which facilitates the assembly of the buckle 1513 and the buckling part 23, and saves the material of the buckle 1513, thus reducing the cost. It should be understood that the number of the reinforcing ribs 1517 can be set according to actual needs to well satisfy practical applications.

According to some embodiments of the present disclosure, a ventilation groove is formed on the atomizing core fixing member 2, and the ventilation channel is defined between the ventilation groove and the atomizing core, wherein the width of the ventilation groove is $W_1$, and the depth of the ventilation groove is $H_1$, in which $W_1$ and $H_1$ meet respectively: 0.25 mm$\leq W_1 \leq$0.5 mm, and 0.1 mm$\leq H_1 \leq$0.4 mm. The width of the ventilation groove 23 can be a distance in the front-back direction as shown in FIG. 8, and the depth of the ventilation groove can be a distance in the top-bottom direction as shown in FIG. 8. For example, $W_1$=0.3 mm, $H_1$=0.3 mm. If $W_1$>0.5 mm, the thickness of the atomizing core fixing member 2 may be large, resulting in a large volume of the atomizer 100, which is not conducive to the miniaturization design; or if $H_1$>0.4 mm, leakage of the medium to be atomized tends to occur after long-time use due to a large depth and a thin bottom wall of the ventilation groove. If $W_1$<0.25 mm or $H_1 \leq$0.4 mm, the width and depth of the ventilation groove are small, which may lead to an unsatisfactory ventilation effect and increase the technological difficulty in manufacturing the ventilation groove 23. Therefore, by setting $W_1$ and $H_1$ to meet: 0.25 mm$\leq W_1 \leq$0.5 mm and 0.1 mm$\leq H_1 \leq$0.4 mm, the effectiveness of internal ventilation in the housing 1 can be increased, the lightening and thinning design of the atomizer 100 is realized while ensuring the ventilation volume, the leakage caused by the infiltration of the medium to be atomized in the ventilation groove due to the small thickness is avoided, and the processing difficulty is reduced, thus improving the production efficiency.

Further, as shown in FIG. 8, the accommodating groove 22 includes a bottom wall, and a side wall connected to an outer peripheral side of the bottom wall. The ventilation groove includes a first ventilation groove 241 and at least one second ventilation groove 242. The first ventilation groove 241 is formed on the bottom wall, and the first ventilation groove 241 has at least one first ventilation port 2411 communicating with the E-liquid storage chamber 11. Here, two first ventilation ports 2411 may be provided. The two first ventilation ports 2411 respectively communicate with the E-liquid storage chamber 11. The second ventilation groove 242 is formed on the side wall, the second ventilation groove 242 communicates with the first ventilation groove 241 and the atomizing chamber 13 respectively, and the second ventilation groove 242 has a depth greater than a depth of the first ventilation groove 241.

Thus, the first ventilation groove 241 is formed on the bottom wall of the accommodating groove 22, the second ventilation groove 242 is formed on the side wall of the accommodating groove 22, and the first ventilation groove 241 communicates with the second ventilation groove 242. These facilitate the air circulation between the atomizing chamber 13 and the E-liquid storage chamber 11, facilitate the lightening and thinning of the atomizer 100 and increase the compactness of the structure of the accommodating groove 22. By setting the depth of the second ventilation groove 242 to be greater than the depth of the first ventilation groove 241, the air is facilitated to enter the ventilation groove to realize ventilation, so that the ventilation effect is better, the flowability of the medium to be atomized is better, and the continuity in the process of atomization using the atomizer 100 is ensured.

In some embodiments, a cross-sectional area of the second ventilation groove 242 gradually decreases in a direction toward the E-liquid storage chamber 11. For example, the depth of the second ventilation groove 242 gradually decreases in a direction from a position far away from the first ventilation groove 241 to a position adjacent to the first ventilation groove 241. The depth of the second ventilation groove 242 at the end adjacent to the first ventilation groove 241 may be equal to the depth of the first ventilation groove 241. Therefore, the cross-sectional area of the second ventilation groove 242 gradually decreases in the direction towards the E-liquid storage chamber 11, which can facilitate the air to enter the ventilation groove and increase the air intake into the ventilation groove. In this manner, the air circulation between the E-liquid storage chamber 11 and the atomizing chamber 13 becomes much better.

Further, the bottom wall of the second ventilation groove 242 extends obliquely toward the center of the atomizing core in a direction toward the E-liquid storage chamber 11. It should be noted that: the bottom wall of the second ventilation groove 242 refers to a side of the second ventilation groove 242 away from the center of the atomizing core. Therefore, the bottom wall of the second ventilation groove 242 gradually inclines toward the center of the atomizing core in a direction toward the E-liquid storage chamber 11. The bottom wall can guide the air entering the second ventilation groove 242 so that the air entering from the gas inlet 1521 can smoothly enter the first ventilation groove 241 through the second ventilation groove 242, to avoid the turbulence of air between the first ventilation groove 241 and the second ventilation groove, and increase the air intake speed.

According to some embodiments of the present disclosure, the first ventilation groove 241 extends along a circumferential direction of the E-liquid storage chamber communicating port 221. The first ventilation port 2411 runs through a side wall of the E-liquid storage chamber communicating port 221 in the thickness direction of the housing 1. The first ventilation groove 241 includes a first side wall and a second side wall. The first side wall is arranged away from the center of the accommodating groove 22, and the second side wall is arranged adjacent to the center of the accommodating groove 22. The first ventilation port 2411 is formed on the second side wall. After the atomizing core is assembled in the accommodating groove 22, the first ventilation port 2411 communicates with the first ventilation groove 241 and the E-liquid storage chamber 11 to realize air exchange. The second ventilation groove 242 is located on a side wall of the accommodating groove 22 in the width direction of the housing 1, and the second ventilation groove 242 extends in the length direction of the housing 1, to bring the first ventilation groove 241 and the atomizing chamber 13 into communication. Therefore, the first ventilation groove 241 extends along the circumferential direction of the E-liquid storage chamber communicating port 221, and the second ventilation groove 242 is located on the side wall of the accommodating groove 22 in the width direction of the housing 1, thereby thinning the accommodating groove 22 and avoiding the leakage of the medium to be atomized from the ventilation groove.

According to some specific embodiments of the present disclosure, referring to FIG. 8, the ventilation groove further includes at least one ventilation communicating section 243. The ventilation communicating section 243 is formed on the bottom wall, has one end communicating with first ventilation groove 241 and the other end extending into the second ventilation groove 242 and communicating with second ventilation groove 242, and has an edge joined to the inner wall of the second ventilation groove 242. Therefore, a ventilation channel is arranged between the first ventilation groove 241 and the second ventilation groove 242, to bring the first ventilation groove 241 and the second ventilation groove 242 into communication. Air can flow between the atomizing chamber 13 and the E-liquid storage chamber 11 through the first ventilation groove 241, the ventilation channel and the second ventilation groove 242. In this way, the smoke can be puffed by the users via inspiratory mouth 141 easily, which increases the comfort of smoking. Moreover, it is convenient for the medium to be atomized in E-liquid storage chamber 11 to flow out of the E-liquid storage chamber 11 for atomization.

According to some embodiments of the present disclosure, as shown in FIGS. 1-3, a seat sealing member 7 is arranged between the atomizing core fixing member 2 and the seat 151. With this arrangement, the seat sealing member 73 fills a gap between the atomizing core component and the seat 151. This can well achieve the sealing of the gap, reduce the probability that the smoke in the atomizing chamber 13 flows out of the atomizing chamber 13 from the gap between the atomizing core component and the seat 151, effectively prevent the leakage of smoke after condensation, and improve the utilization of smoke in the atomizing chamber 13, thus improving the effective utilization of the medium to be atomized.

Further, the seat sealing member 7 includes a first seat sealing section 71 and a second seat sealing section 72. The first seat sealing section 71 is arranged between the atomizing core fixing member 2 and the seat assembly 15. The second seat sealing section 72 is connected to the first seat sealing section 71, and arranged between an outer peripheral surface of the seat assembly 15 and an inner peripheral surface of the shell 14.

For example, in the embodiments shown in FIGS. 1-2 and 12-13, a top surface of the first seat sealing section 71 abuts against a bottom surface of the atomizing core fixing member 2, a bottom surface of the first seat sealing section 71 abuts against a top surface of the seat 151, an outer peripheral surface of the second seat sealing section 72 abuts against the inner peripheral surface of the shell 14, and an inner peripheral surface of the second seat sealing section 72 abuts against the outer peripheral surface of the seat 151. With this arrangement, the first seat sealing section 71 can be used to seal a gap between the bottom of the atomizing core fixing member 2 and the top of the seat 151, and the second seat sealing section 72 can seal a gap between the inner wall of the shell 14 and the seat 151 in the circumferential direction. Therefore, the sealing between the atomizing core fixing member 2, the shell 14 and the seat 151 is further improved, the leakage of smoke in the atomizing chamber 13 is well reduced, and the assembly between the seat 151, the atomizing core fixing member 2 and the shell 14 can be tightened.

According to some embodiments of the present disclosure, as shown in FIGS. 7-9, at least one E-liquid storage groove 25 is formed on the atomizing core fixing member 2. For example, the E-liquid storage groove 25 is used to store some liquid medium generated in the atomizing core fixing member 2. When the high-temperature smoke generated by atomization of the liquid medium encounters the low-temperature air entered via the gas inlet 1521, a part of the high-temperature smoke will condense to form a liquid medium attached to a surface of the E-liquid storage groove 25. The E-liquid storage groove 25 can collect this part of liquid. The width of the E-liquid storage groove 25 is $W_2$, and the depth of the E-liquid storage groove 25 is $H_2$, in which $W_2$ and $H_2$ respectively meet: $0.25\ mm \leq W_2 \leq 0.5\ mm$, and $0.1\ mm \leq H_2 \leq 0.4\ mm$. In an example, $W_2=0.35$ mm, and $H_2=0.25$ mm. However, the present disclosure is not limited thereto.

Further, as shown in FIG. 7, the width of the E-liquid storage groove 25 gradually increases in a direction from a bottom of the E-liquid storage groove 25 to an opening of the E-liquid storage groove 25. A cross-section of the E-liquid storage groove 25 may be trapezoidal. The bottom of the E-liquid storage groove 25, that is, a side of the E-liquid storage groove 25 adjacent to the center of the atomizing core fixing member 2, is shorter than a side of the E-liquid storage groove 25 away from the center of the atomizing core fixing member 2. Therefore, the width of the opening of the E-liquid storage groove 25 is larger than the width of the bottom, to facilitate the attachment of the condensed liquid medium on the surface of the E-liquid storage groove 25 and increase a contact area between the E-liquid storage groove 25 and the liquid medium.

Still further, referring to FIG. 7, multiple E-liquid storage grooves 25 are provided. The multiple E-liquid storage groove 25 includes at least one first E-liquid storage groove 251 and at least one second E-liquid storage groove 252. The first E-liquid storage groove 251 extends in the length direction of the housing 1, and the second E-liquid storage groove 252 extends in the width direction of the housing 1. Therefore, the E-liquid storage groove 25 includes multiple first E-liquid storage grooves 251 extending in the length direction and multiple second E-liquid storage grooves 252 extending in the width direction. This fully increases the contact between the E-liquid storage groove 25 and the condensed liquid medium, and increases the E-liquid storage capacity of the E-liquid storage groove 25.

According to some embodiments of the present disclosure, as shown in FIG. 7, multiple convex ribs are arranged on the outer surface of the atomizing core fixing member 2. The multiple convex ribs include multiple first convex ribs 26 and multiple second convex ribs 27. The multiple first convex ribs 26 are arranged at intervals in the width direction of the housing 1 and extend in the length direction of the housing 1, and the first E-liquid storage groove 251 is defined between two adjacent first convex ribs 26. The multiple second convex ribs 27 are arranged at intervals in the length direction of the housing 1 and extend in the width direction of the housing 1, and the second E-liquid storage groove 252 is defined between at least two adjacent second convex ribs 27. Therefore, the multiple first E-liquid storage grooves 251 and the multiple second E-liquid storage grooves 252 can be respectively defined by the multiple first convex ribs 26 and the multiple second convex ribs 27 at intervals. This can increase the structural strength of the atomizing core fixing member 2, facilitate the storage of the condensed liquid media and increase the storage capacity of the liquid medium.

Further, at least portions of two adjacent second convex ribs 27 overlap in the length direction of the housing 1. It can be understood that two adjacent second convex ribs 27 can extend in the width direction of the housing 1, and orthographic projections formed by the two adjacent second convex ribs 27 at least partially overlap in the length direction of the housing 1. Therefore, at least portions of the two second convex ribs 27 overlap in the length direction of the housing 1, and the storage capacity of the condensed liquid medium can be increased. For example, when the liquid medium falls along the length direction of the housing 1, the second convex rib 27 can increase the contact area with the liquid medium, which is convenient for storing this part of liquid medium. Moreover, the space on the outer surface of the atomizing core fixing member 2 can be fully utilized, to improve the utilization of the space on the outer surface of the atomizing core fixing member 2.

According to some embodiments of the present disclosure, referring to FIG. 7, an atomizing chamber communicating port 28 and an accommodating groove 29 are formed on at least a side surface of the atomizing core fixing member 2 in the thickness direction of the housing 1. The atomizing chamber communicating port 28 runs through a side wall of the atomizing core fixing member 2. The accommodating groove 29 is located at a side of the atomizing chamber communicating port 28 adjacent to the E-liquid storage chamber 11 and communicates with the atomizing chamber communicating port 28. That is, the accommodating groove 29 can be arranged on the side surface of the atomizing core fixing member 2 formed with the multiple convex ribs. The multiple first convex ribs 26 and the multiple second convex ribs 27 are all arranged in the accommodating groove 29. A stop rib 291 is arranged in the accommodating groove 29, and the stop rib 291 is joined to a side edge (an upper edge of the atomizing chamber communicating port 28) of the atomizing chamber communicating port 28 adjacent to the E-liquid storage chamber 11. One end of the stop rib 291 is connected to one side wall of the accommodating groove 29 in the width direction of the housing 1, and the other end of the stop rib 291 is spaced apart from the other side wall of the accommodating groove 29 in the width direction of the housing 1.

A side edge of the atomizing chamber communicating port 28 away from the first convex rib 26 in the width direction of the housing 1 is a side edge of the accommodating groove 29 away from the first convex rib 26. One end of the stop rib 291 is connected to the edge. The other end of the stop rib 291 extends in the width direction of the housing 1, and is arranged to be spaced apart from an edge opposite to the above mentioned edge in the width direction of the housing 1.

Therefore, the first convex rib 26, the second convex rib 27 and the stop rib 291 are all arranged in the accommodating groove 29. This facilitates the arrangement of the convex ribs and the stop rib 291, avoids the convex ribs and the stop rib 291 from excessively protruding from the outer surface of the atomizing core fixing member 2 in the thickness direction of the housing 1, increases the space between the atomizing core fixing member 2 and the housing 1, ensures the depths of the first E-liquid storage groove 251 and the second E-liquid storage groove 252 and the communication of the atomizing chamber 13 and the accommodating groove 29, and increases the storage capacity of the liquid medium formed by the condensation of some smoke due to the encountering of low-temperature air and high-temperature smoke during atomization. The stop rib 291 can improve the structural strength of the accommodating groove 29, and prevent the liquid medium in the first E-liquid storage groove 251 and the second E-liquid storage groove 252 from flowing from the atomizing chamber communicating port 28 to the atomizing chamber 13, so as to make the smoke for puffing healthier.

Further, as shown in FIG. 7, the accommodating groove 29 has an accommodating groove communicating port 292, which runs through a side wall of the atomizing chamber communicating port 28, and is located below the stop rib 291. The accommodating groove communicating port 292 brings the accommodating groove 29 and the atomizing chamber communicating port 28 into communication. Part of smoke in the atomizing chamber 13 can enter the accommodating groove 29 along the accommodating groove communicating port 292, and is condensed in the accommodating groove 29. Therefore, the arranged accommodating groove communicating port 292 facilitates part of the smoke to enter the accommodating groove 29, and then the smoke is condensed in the accommodating groove 29 to form a liquid medium attached to or stored in the E-liquid storage groove 25, so as to avoid leakage of the E-liquid from the atomizer 100.

According to some embodiments of the present disclosure, as shown in FIGS. 7-9, multiple atomization guide channels 21 are provided. One end of each atomization guide channel 21 communicates with the atomizing chamber 13, and the other end of each atomization guide channel 21 communicates with the aerosol passage 12. A partition 8 is arranged between the other ends of the multiple atomization guide channels 21 and the aerosol passage 12. The partition 8 is configured to space apart the other ends of the multiple atomization guide channels 21 and direct a gas flow from the multiple atomization guide channels 21 to the aerosol passage 12.

Referring to FIGS. 7-9, two atomization guide channels 21 may be provided. The two atomization guide channels 21 are respectively formed at two ends of the atomizing core fixing member 2 in the length direction. The partition 8 is arranged between ends of the two atomization guide channels 21 adjacent to the aerosol passage 12 and the aerosol passage 12. When the atomizer 100 operates, the atomized medium in the atomizing chamber 13 can flow to the partition 8 through the two atomization guide channels 21. At this time, the partition 8 can divide the two streams of atomized medium flowing to the partition 8 into multiple streams, to prevent turbulence of the atomized medium at the joint between the atomizing core fixing member 2 and the aerosol passage 12, allow the atomized medium to smoothly flow to the aerosol passage 12, and further reduce the resistance when the electronic cigarette is puffed by the users and improve the user experience.

Further, an atomization communicating channel 30 is formed on the atomizing core fixing member 2. The atomization communicating channel 30 is arranged between and communicates with the other ends of the multiple atomization guide channels 21 and the aerosol passage 12; and the partition 8 is arranged at the atomization communicating channel 30. As shown in FIGS. 7 and 8, the atomization communicating channel 30 is formed at one end of the atomization core fixing member 2 adjacent to the aerosol passage 12. One end of the atomization communicating channel 30 communicates with the aerosol passage 12, and the other end of the atomization communicating channel 30 communicates with the atomization guide channel 21. The shape of the partition 8 can be an isosceles triangle, both ends of the long side of the partition 8 are connected to the inner wall of the atomization communicating channel 30, and the partition 8 extends toward the atomizing chamber 13. Since the atomized medium is prone to turbulence at the atomization communicating channel 30, the atomized medium in the atomization communicating channel 30 can be dispersed by arranging the partition 8 at the atomization communicating channel 30, so as to prevent the atomized medium from turbulence in the atomization communicating channel 30, and ensure the smoothness when the electronic cigarette is puffed by a user.

Still further, as shown in FIGS. 7-9, the aerosol passage 12 extends in the length direction of the housing 1. The atomization communicating channel 30 includes a first communicating channel section 301 and a second communicating channel section 302 connected sequentially toward a direction away from the aerosol passage 12 in the length direction of the housing 1. One end of the aerosol passage 12 is located in the first communicating channel section 301, and the partition 8 is located in the second communicating channel section 302.

For example, in the embodiments shown in FIGS. 7-9, the shape of the accommodating groove 22 is adapted to the shape of the atomizing core to firmly install the atomizing core on the atomizing core fixing member 2. Each atomization guide channel 21 is substantially L-shaped, which increases the length of the atomization guide channel 21. In this manner, the flow path of the atomized medium is extended, so that the atomized medium can be fully mixed with air. When the atomizer 100 operates, the atomized medium atomized by the atomizing core can flow into the second communicating channel section 302 through the first guide channel section and the second guide channel section. The atomized medium mixture in the second communicating channel section 302 flows into the first communicating channel section 301 after being divided by the partition 8, and then and then flows through the first communicating channel section 301 and the aerosol passage 12 to the user's mouth via the inspiratory mouth 141.

According to some embodiments of the present disclosure, the atomizer 100 further includes an atomizing core fixing and sealing member 9. The atomizing core fixing and sealing member 9 is arranged on the atomizing core fixing member 2, at least partially located between the atomizing core fixing member 2 and the inner wall of the housing 1 and between an outer peripheral surface of the aerosol passage 12 and an inner wall of the first communicating channel section 301. Referring to FIG. 7 in conjunction with FIGS.

1 and 2, the atomizing core fixing and sealing member 9 includes a first sealing section 91, a second sealing section 92 and a third sealing section 93 connected to each other. The first sealing section 91 is arranged at a side of the atomizing core fixing member 2 adjacent to the E-liquid storage chamber 11. The second sealing member is located between the atomizing core fixing member 2 and the inner wall of the housing 1. The third sealing section 93 is located between a step portion of the aerosol passage 12 and the inner wall of the first communicating channel section 301. As a result, the atomizing core fixing member 2 and the housing 1 are in interference fit, and the aerosol passage 12 and the inner wall of the first communicating channel section 301 are in interference fit. Therefore, the leakage of the medium to be atomized in the E-liquid storage chamber 11 from the gap between the inner wall of the housing 1 and the atomizing core fixing member 2 can be avoided. Also, the leakage of the medium to be atomized in the E-liquid storage chamber 11 from a gap between the aerosol passage 12 and the inner wall of the first communicating channel section 301 can be avoided.

According to an embodiment in a second aspect of the present disclosure, a cartridge (not shown) includes the atomizer 100 for the electronic cigarette according to the embodiment of the first aspect of the present disclosure.

In the cartridge according to the embodiment of the present disclosure, the atomizer 100 is used, by which the atomized medium can smoothly flow to the user's mouth, so as to improve the user experience.

According to an embodiment in a third aspect of the present disclosure, an electronic cigarette includes the atomizer 100 for the electronic cigarette according to the embodiment in the first aspect of the present disclosure or the cartridge according to the embodiment in the second aspect of the present disclosure.

In the electronic cigarette according to the embodiment of the present disclosure, the atomizer 100 and the cartridge are used, to reduce the resistance when the electronic cigarette is puffed by the user, and ensure the user experience.

Other configurations and operations of the electronic cigarette according to the embodiments of the present disclosure are known to those of ordinary skill in the art and will not be described in detail herein.

In the description of the present disclosure, it should be understood that directions or location relationships indicated by the terms "center", "longitudinal", "transverse", "length", "width", "thickness", "upper", "lower", "front", "rear", "left", "right", "vertical", "horizontal", "top", "bottom", "inner", and "outer" are directions or location relationships shown based on the accompanying drawings, are merely used for the convenience of describing the present disclosure and simplifying the description, but are not used to indicate or imply that a device or an element must have a particular direction or must be constructed and operated in a particular direction, and therefore, cannot be understood as a limitation to the present disclosure.

In the description of the present disclosure, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art can understand the specific meanings of the foregoing terms in the present disclosure according to specific situations.

In the description of this specification, the description of the reference terms such as "an embodiment", "some embodiments", "exemplary embodiments", "example", "specific example", or "some examples" means that the specific features, structures, materials or characteristics described with reference to the embodiment or example are included in at least one embodiment or example of the present disclosure. In the present disclosure, the illustrative expression of the above terms is not necessarily referring to the same embodiment or example.

Although the embodiments of the present disclosure have been shown and described, a person of ordinary skill in the art should understand that various changes, modifications, replacements and variations may be made to the embodiments without departing from the principles and spirit of the present disclosure, and the scope of the present disclosure is as defined by the appended claims and their equivalents.

What is claimed is:

1. An atomizer for an electronic cigarette, comprising:

a housing, wherein an E-liquid storage chamber, an aerosol passage, and an atomizing chamber communicating with the aerosol passage are located in the housing; and at least one gas inlet communicating with the atomizing chamber and an inspiratory mouth communicating with the aerosol passage are located on the housing, wherein the gas inlet is located on a side surface of the housing; and the housing has a length direction, a width direction, and a thickness direction, wherein a dimension of the housing in the thickness direction is D, a dimension of the housing in the length direction is L, and a dimension of the housing in the width direction is W, in which D, L and W meet: $L>W\geq D$, $5\leq L/D\leq 9$, and $2\leq W/D\leq 5$; and an atomizing core fixing member located in the housing, wherein the atomizing core fixing member separates the E-liquid storage chamber from the atomizing chamber, and the atomizing core fixing member is provided with an atomizing core; wherein the atomizing core communicates with the E-liquid storage chamber and the atomizing chamber respectively, and the atomizing core is configured to atomize a medium to be atomized in the E-liquid storage chamber; and at least one atomization guide channel is defined between the atomizing core fixing member and an inner wall of the housing, the at least one atomization guide channel is separated from the E-liquid storage chamber, and the atomization guide channel communicates with the aerosol passage and the atomizing chamber, wherein the housing comprises:

a shell, having one open end, wherein the inspiratory mouth is formed on another end of the housing; and a seat assembly, located at the open end of the shell, wherein the E-liquid storage chamber, the aerosol passage and the atomizing chamber are defined between the seat assembly and the shell; and the seat assembly comprises a seat and a seat shell, the seat shell is located at a side of the seat away from a center of the housing, wherein the gas inlet is formed on a side surface of the seat shell, and a gas intake passage bringing the gas inlet and the atomizing chamber into communication is formed on the seat.

2. The atomizer for the electronic cigarette according to claim 1, wherein the dimension D further meets: $5.0\ mm\leq D\leq 9.0\ mm$.

3. The atomizer for the electronic cigarette according to claim 1, wherein a length $L_1$ of the atomizing core is a dimension of the atomizing core along the width direction of the housing, a width $w_1$ of the atomizing core is a dimension of the atomizing core along the thickness direction of the housing, and $L_1$ and $w_1$ meet: $2 \leq L_1/w_1 \leq 5$; and/or, $$2 \text{ mm} \leq w_1 \leq 3.5 \text{ mm}.$$

4. The atomizer for the electronic cigarette according to claim 3, wherein a groove is formed on a side surface of the atomizing core facing the E-liquid storage chamber, and a thickness of the atomizing core at a position corresponding to a bottom wall of the groove is $t_1$, in which $t_1$ meets: 0.6 mm$\leq t_1 \leq$2.5 mm; and/or, wherein a thickness of the atomizing core at a position corresponding to a side wall of the groove is $t_2$, in which $t_2$ meets: 0.6 mm$\leq t_2 \leq$1.5 mm; and/or, wherein the thickness of the atomizing core at the position corresponding to the side wall of the groove is $t_2$, in which $w_1$ and $t_2$ meet: $2.5 \leq w_1/t_2 \leq 6$; and/or, wherein a dimension of the groove along the thickness direction of the housing is a width w2 of the groove, in which $w_1$ and $w_2$ meet: $1.5 \leq w_1/w_2 \leq 6$.

5. The atomizer for the electronic cigarette according to claim 1, wherein a side surface of the seat away from the E-liquid storage chamber is at least partially spaced apart from an inner wall of the seat shell to define at least one communicating channel, wherein the gas inlet is brought into communication with the gas intake passage by the communicating channel.

6. The atomizer for the electronic cigarette according to claim 5, wherein the side surface of the seat away from the E-liquid storage chamber is provided with at least one support member, wherein the support member abuts against the inner wall of the seat shell, and at least a portion of an outer peripheral surface of the support member is spaced apart from an inner peripheral surface of the seat shell to define the communicating channel.

7. The atomizer for the electronic cigarette according to claim 5, further comprising:

a gas resistance adjusting member, located at the gas intake passage;

wherein a communicating hole is formed on the gas resistance adjusting member, wherein the communicating hole brings the gas inlet and the atomizing chamber into communication, and the communicating hole has an inner diameter d, in which d meets: 0.8 mm$\leq$d$\leq$1.5 mm.

8. The atomizer for the electronic cigarette according to claim 5, wherein an electrically conductive member extends through the seat; and an accommodating groove is formed on the atomizing core fixing member, and the atomizing core is located in the accommodating groove; an E-liquid storage chamber communicating port is formed at a side of the accommodating groove adjacent to the E-liquid storage chamber, and the E-liquid storage chamber is brought into communication with the atomizing core through the E-liquid storage chamber communicating port; the accommodating groove has an open side opening toward the atomizing chamber, and the atomizing core communicates with the atomizing chamber via the open side; one end of the electrically conductive member extends through the open side into the accommodating groove and is electrically connected to the atomizing core; and the atomizing core is abutted against and between an inner side wall of the accommodating groove facing the E-liquid storage chamber and the electrically conductive member, so that the atomizing core is fixed, wherein an atomizing core sealing member is arranged between an inner side wall of the accommodating groove adjacent to the E-liquid storage chamber and the atomizing core, and a sealing member communicating port is formed to run through the atomizing core sealing member, wherein the E-liquid storage chamber communicates with the atomizing core via the E-liquid storage chamber communicating port and the sealing member communicating port.

9. The atomizer for the electronic cigarette according to claim 8, wherein the seat is provided with at least one buckle; and at least one buckling part is formed on the atomizing core fixing member, and the buckle mates with the buckling part to buckle the atomizing core fixing member to the seat assembly.

10. The atomizer for the electronic cigarette according to claim 9, wherein the buckling part comprises a buckling part guiding face that extends obliquely towards the buckle in a direction from the seat assembly to a center of the shell; and the buckling portion comprises a first buckle guiding face that extends obliquely away from the buckling part in the direction from the seat assembly to the center of the shell;

wherein the buckle comprises a second buckle guiding face, the second buckle guiding face is located at a side of the buckle away from the buckling portion, and extends obliquely towards the buckling part in the direction from the seat assembly to the center of the shell.

11. The atomizer for the electronic cigarette according to claim 8, wherein a ventilation groove is located on the atomizing core fixing member, and the ventilation channel is located between the ventilation groove and the atomizing core, wherein a width of the ventilation groove is $W_1$, and a depth of the ventilation groove is $H_1$, in which $W_1$ and $H_1$ meet respectively: 0.25 mm$\leq W_1 \leq$0.5 mm, and 0.1 mm$\leq H_1 \leq$0.4 mm.

12. The atomizer for the electronic cigarette according to claim 11, wherein the accommodating groove comprises a bottom wall, and a side wall connected to an outer peripheral side of the bottom wall; and the ventilation groove comprises:

a first ventilation groove, located on the bottom wall, and having at least one first ventilation port communicating with the E-liquid storage chamber; and at least one second ventilation groove, located on the side wall, communicating with the first ventilation groove and the atomizing chamber respectively, and having a depth greater than a depth of the first ventilation groove;

wherein a cross-sectional area of the second ventilation groove gradually decreases in a direction toward the E-liquid storage chamber;

wherein a bottom wall of the second ventilation groove extends obliquely in the direction toward the E-liquid storage chamber and a direction toward the center of the atomizing core.

13. The atomizer for the electronic cigarette according to claim 12, wherein the ventilation groove further comprises:

at least one ventilation communicating section, formed on the bottom wall, one end of the ventilation communicating section is in communication with the first ventilation groove and another end extends into the second ventilation groove and communicates with the second ventilation groove, and an edge of the ventilation communicating section is joined to an inner wall of the second ventilation groove.

14. The atomizer for the electronic cigarette according to claim 5, wherein a seat sealing member is located between the atomizing core fixing member and the seat;

wherein the seat sealing member comprises:

a first seat sealing section, located between the atomizing core fixing member and the seat assembly; and a second seat sealing section, connected to the first seat sealing section, and located between an outer peripheral surface of the seat assembly and an inner peripheral surface of the shell.

15. The atomizer for the electronic cigarette according to claim 1, wherein at least one E-liquid storage groove is formed on the atomizing core fixing member; and a width of the E-liquid storage groove is $W_2$, and a depth of the E-liquid storage groove is $H_2$, in which $W_2$ and $H_2$ meet respectively: 0.25 mm$\leq W_2 \leq$0.5 mm, and 0.1 mm$\leq H_2 \leq$0.4 mm;

wherein the width of the E-liquid storage groove gradually increases in a direction from a bottom of the E-liquid storage groove to an opening of the E-liquid storage groove.

16. The atomizer for the electronic cigarette according to claim 15, wherein the at least one E-liquid storage groove comprises a plurality of E-liquid storage grooves, and the plurality of E-liquid storage grooves comprise:

at least one first E-liquid storage groove, extending along the length direction of the housing; and at least one second E-liquid storage groove, extending along the width direction of the housing;

wherein a plurality of convex ribs are arranged on an outer surface of the atomizing core fixing member, and the plurality of convex ribs comprise:

a plurality of first convex ribs, arranged at intervals along the width direction of the housing and extending along the length direction of the housing, wherein the first E-liquid storage groove is defined between two adjacent first convex ribs; and a plurality of second convex ribs, arranged at intervals along the length direction of the housing and extending along the width direction of the housing, wherein the second E-liquid storage groove is defined between at least two adjacent second convex ribs.

17. The atomizer for the electronic cigarette according to claim 16, wherein an atomizing chamber communicating port and an accommodating groove are formed on at least a side surface of the atomizing core fixing member in the thickness direction of the housing, wherein the atomizing chamber communicating port runs through a side wall of the atomizing core fixing member; the accommodating groove is located at a side of the atomizing chamber communicating port adjacent to the E-liquid storage chamber and communicates with the atomizing chamber communicating port; the plurality of first convex ribs and the plurality of second convex ribs are located in the accommodating groove; and a stop rib is located in the accommodating groove, the stop rib is joined to a side edge of the atomizing chamber communicating port adjacent to the E-liquid storage chamber, and one end of the stop rib is connected to one side wall of the accommodating groove in the width direction of the housing and another end of the stop rib is spaced apart from another side wall of the accommodating groove in the width direction of the housing.

18. The atomizer for the electronic cigarette according to claim 1, wherein the at least one atomization guide channel comprises a plurality of atomization guide channels, wherein one end of each of the atomization guide channels is in communication with the atomizing chamber and another end is in communication with the aerosol passage; and wherein a partition is located between the other ends of the plurality of atomization guide channels and the aerosol passage, and the partition is configured to separate the other ends of the plurality of atomization guide channels and direct a gas flow from the plurality of atomization guide channels to the aerosol passage;

wherein an atomization communicating channel is formed on the atomizing core fixing member, and is located between and communicates with the other ends of the plurality of atomization guide channels and the aerosol passage; and the partition is located at the atomization communicating channel.

19. A cartridge, comprising: the atomizer for the electronic cigarette according to claim 1.

20. An electronic cigarette, comprising: the atomizer for the electronic cigarette according to claim 1.

* * * * *